US006126506A

United States Patent [19]

Rudy

[11] Patent Number: 6,126,506

[45] Date of Patent: Oct. 3, 2000

[54] MULTI-BLOCK STRUCTURE WITH MULTIPLE RAIL CONFIGURATION AND PIVOT MEANS

[75] Inventor: Eric A. Rudy, Philadelphia, Pa.

[73] Assignee: 90Degrees, Inc., Philadelphia, Pa.

[21] Appl. No.: 09/210,324

[22] Filed: Dec. 11, 1998

[51] Int. Cl.[7] ..... A63H 33/04

[52] U.S. Cl. ..... 446/85; 446/124; 446/127

[58] Field of Search ..... 446/1, 85, 102, 446/104, 105, 106, 108, 122, 124, 126, 127

[56] References Cited

U.S. PATENT DOCUMENTS

| | | | |
|---|---|---|---|
| D. 221,092 | 7/1971 | Daenen et al. | D34/15 |
| D. 233,542 | 11/1974 | Christiansen | D34/15 GG |
| D. 290,627 | 6/1987 | Dideriksen | D21/108 |
| D. 311,935 | 11/1990 | Andersen | D21/108 |
| D. 336,120 | 6/1993 | Knudsen | D4/108 |
| D. 355,452 | 2/1995 | Glynn | D21/108 |
| D. 356,124 | 3/1995 | Glynn | D21/108 |
| D. 377,377 | 1/1997 | Glynn | D21/108 |
| 1,281,856 | 10/1918 | Shaw . | |
| 2,020,562 | 11/1935 | Miller . | |
| 2,077,065 | 4/1937 | Johannes . | |
| 3,127,175 | 3/1964 | White . | |
| 3,234,683 | 2/1966 | Christiansen . | |
| 3,242,610 | 3/1966 | Christiansen . | |
| 3,415,007 | 12/1968 | Howe . | |
| 3,545,122 | 12/1970 | Onanian . | |
| 3,597,875 | 8/1971 | Christiansen . | |
| 3,640,017 | 2/1972 | Christiansen . | |
| 3,667,153 | 6/1972 | Christiansen . | |
| 3,690,031 | 9/1972 | Shinoda . | |
| 3,791,090 | 2/1974 | Kniefel | 52/593 |
| 3,803,754 | 4/1974 | Fischer | 446/85 |
| 4,044,497 | 8/1977 | Bettens . | |
| 4,182,072 | 1/1980 | Much . | |
| 4,185,410 | 1/1980 | Kristiansen . | |
| 4,253,268 | 3/1981 | Mayr . | |
| 4,345,762 | 8/1982 | Lebelson | 446/124 |
| 4,403,733 | 9/1983 | Bach et al. | 238/10 |
| 4,726,515 | 2/1988 | Bolli et al. | 238/10 |
| 5,049,104 | 9/1991 | Olsen | 446/104 |
| 5,061,218 | 10/1991 | Garage et al. | 446/102 |
| 5,094,643 | 3/1992 | Bolli et al. | 446/121 |
| 5,209,693 | 5/1993 | Lyman | 446/104 |
| 5,411,428 | 5/1995 | Orii et al. | 446/90 |
| 5,421,762 | 6/1995 | Glickman | 446/127 |
| 5,427,558 | 6/1995 | Knudsen | 446/102 |
| 5,527,201 | 6/1996 | Maddock | 446/104 |
| 5,853,313 | 12/1998 | Zheng | 446/106 |
| 5,853,314 | 12/1998 | Bora | 446/102 |
| 5,984,756 | 11/1999 | Krog | 446/127 |

OTHER PUBLICATIONS

Lego Technic Electric Motor System (date unknown).

*Primary Examiner*—Sam Rimell
*Attorney, Agent, or Firm*—Kenneth P. Glynn, Esq.

[57] ABSTRACT

A toy block set includes a plurality of toy block configurations that are slidably, pivotally and fixably coupled to one another and which are further capable of three dimensional slidable and pivotal maneuvering with respect to one another by virtue of rail extension members, rail guide members and pivot members. A first group of the block configurations includes embodiments with a rail extension member which consists of a first thinner segment and a second wider segment. A second group of the block configurations includes embodiments with rail guide members which are configured to permit multi-directional movement of the rail extension members therethrough. A third group of the block configurations includes embodiments with pivot members which are configured to permit multi-directional pivotal and slidable movement of the rail extension members therethrough. In an alternative embodiment, the rail extension members may be independent pieces.

33 Claims, 23 Drawing Sheets

MULTI-BLOCK STRUCTURE WITH MULTIPLE RAIL CONFIGURATION AND PIVOT MEANS

BACKGROUND OF THE INVENTION

1. Field of the Invention

The present invention relates to toy block sets and more precisely to toy block sets which include a plurality of toy blocks that are slidably, pivotally and fixably coupled to one another and which are further capable of three dimensional slidable and pivotal maneuvering with respect to one another by virtue of rail extension members, rail guide members and pivot members.

2. Information Disclosure Statement

The following patents describe the state of the art in toy blocks and toy block sets.

Lego® Technic presently demonstrates an electric motor system which includes a rectangular Lego® piece having a pair of symmetrical protrusions and having centrally located on one side wall an extension which includes a first thinner portion which extends longitudinally across the entire length of the side wall of the rectangular block and a second wider portion having the same height as the main body of the block.

U.S. Design Pat. No. 221,092 shows a component for a multi-pieced block which has circular recesses and also shows cut-outs opposite one another.

U.S. Design Pat. No. 233,542 shows a toy building element that includes symmetric protrusions and slotted side extensions opposite one another.

U.S. Design Pat. No. 290,627 shows a toy building element with a telescopic extension having symmetrical protrusions.

U.S. Design Pat. No. 311,935 shows a toy building element having a square base and a circular extension with symmetric protrusions.

U.S. Design Pat. No. 336,120 shows a toy building block having hour glass and semi-hourglass shaped bores and centrally located circular bores.

U.S. Design Pat. No. 336,666 shows a toy building block having rectangular bores and a central circular bore.

U.S. Design Pat. No. 355,452 shows a toy I-beam block having an extended beam located between like square blocks.

U.S. Design Pat. No. 356,124 shows a toy I-beam and block wherein the I-beam is extended outwardly from the side of the block.

U.S. Design Pat. No. 367,898 shows a toy construction block with a T-slot for allowing interconnection with T-shaped members.

U.S. Design Pat. No. 377,377 shows a toy construction block with a plurality of T-slots for allowing interconnection with T-shaped members.

U.S. Pat. No. 1,281,856 shows different toy block configurations with grooves and recesses which retain elongated rectangular fixed pieces.

U.S. Pat. No. 2,020,562 teaches a set of blocks having outer exposed surfaces which enable interlocking joinder via interlocking recesses and partial interlocking projections which enable slidable and frictional union thereof.

U.S. Pat. No. 2,077,065 shows a toy log block house configuration which has rectangular plate-like slabs for interconnection with corresponding blocks with cut-outs thereon.

U.S. Pat. No. 3,034,254 describes a toy building block including inclined side faces and symmetrical protrusions.

U.S. Pat. No. 3,127,175 shows a railroad puzzle game which includes slidable box cars which engage extension tracks such that inner edges of the track are provided with undercut grooves which correspond to extending flanges on the box cars.

U.S. Pat. No. 3,234,683 teaches a toy building element comprising a rectangular block having top, side, and end walls defining a cavity and at least one pair of projections within said cavity, an insert fitted into said cavity comprising a plate having the same outline as the internal face of the top wall of said block and on its inner face at least one pair of projections providing a clamping engagement with the projections of said block, said projections, top, and insert forming a channel within said cavity transverse to opposing walls of said block adapted to receive a bushing, and a bushing rotatably disposed within said channel, at least one of said opposing walls having an aperture therein aligned with said bushing and adapted to receive a spindle for insertion in said bushing.

U.S. Pat. No. 3,242, 610 teaches a flexible interconnector for interconnecting plastic building blocks of the type having a pattern of protuberances on an outer surface thereof and means within the blocks for individually frictionally engaging with said protuberances, comprising at least two flat sheets mutually interconnected by a single, integral means comprising a member narrow but thick in relation to said sheets and sufficiently long and flexible readily to permit movement to said sheets having on one surface thereof means comprising a pattern of protuberances corresponding to at least enough of the pattern of the protuberances of the blocks with which it is to be used to be individually frictionally engaged by means within the blocks.

U.S. Pat. No. 3,415,007 shows a toy building blocks set which includes brick-like block elements with extended portions and central grooves for allowing inner-connection with other like blocks.

U.S. Pat. No. 3,545,122 shows various blocks having orthogonal recessed faces which may be coupled with like projections so as to permit interconnection of such blocks.

U.S. Pat. No. 3,597,875 shows toy building blocks of similar shape but constructed to different modules. They are buildable together and, to this end, the inner protrusions of the smaller blocks coact with the outer projections of the larger blocks differently from the coaction within the module.

U.S. Pat. No. 3,640,017 shows a slide-bar assembly which includes a rectangular elongated hollow female member and an elongated male member adapted for slidable mounting within the female member. The slide-bar assembly, however, teaches slidable movement along only one axis.

U.S. Pat. No. 3,667,153 shows the coupling of two plate-shaped elements by means of an interlocking arrangement formed along the edges of the elements. The locking members of one element are in resilient engagement with identical locking members on the other element, the thickness of the element and the members being strategered alternately to one side and the other of a plane through the center of the edge parallel to the side faces of the element.

U.S. Pat. No. 3,690,031 teaches a toy block set wherein all of the blocks have the same configuration and dimensions and wherein each of said blocks includes rectilinear guide grooves which serve as tracks for guiding a toy vehicle thereupon.

U.S. Pat. No. 3,791,090 teaches toy building blocks having dovetail tongue and groove configurations for interlocking with adjacent blocks by sliding in a longitudinal direction to achieve connection.

U.S. Pat. No. 3,803,754 teaches an assembly kit which comprises a plurality of prismatic building blocks each having at least one face portion provided with a narrow elongated slit being a rectilinear non-circular crosssectional outline. A plurality of connecting elements are provided, and each comprises a pair of connecting portions complimentary to said slits and having transversely established portions which are resiliently deformed upon insertion into the slits of registering blocks.

U.S. Pat. No. 4,044,497 shows a construction kit that comprises male and female elements, preferably of molded plastic material, for assembly into various model structures. The male elements have cubic bodies with studs protruding from two or more faces and the female elements are elongated U-section pieces having corresponding square end walls with keyhole-shaped openings for receiving and gripping shanks of the studs whose heads are guided and held between the lateral walls of the female elements. The male elements can be formed interengaging pieces, and may possibly be pivotally joined.

U.S. Pat. No. 4,182,072 teaches a toy construction kit is provided which includes, as basic building elements, a plurality of interlockable plate members, each plate member having a tongue along one side and a groove along the other side whereby two or more plate members can be connected together in a tongue and groove fashion to form a composite structural member with the preferred composite structural member being a hollow polyhedron such as a right rectangular prism. The plate members have apertures for receiving dowel members which have a slot extending along their length so that each dowel member may be force-inserted into one of the apertures for being compressively retained therein. The dowel members also have keyhole-shaped apertures on each end for receiving flat panel members and lock pins. Disc-shaped hubs, wheels and angle blocks are provided for being carried by the dowel members. The angle blocks are provided with projecting pins for being received in the apertures of the plate members. The angle blocks further have a central aperture for receiving a dowel member and have a keyhole-shaped aperture in each projecting pin. The lock pin may be received in the keyhole-shaped aperture of the dowel members.

U.S. Pat. No. 4,185,410 shows a suspension device for slidable and pivotal suspension of a base plate for toy building sets or base boards for visual planning panels. One face of the base plate or board is provided with rows of coupling studs including a plurality of studs informally spaced apart in both longitudinal and transverse directions, and the suspension device includes a gripping member having inwardly projecting guides adapted to slide along the base plate between a pair of rows of projections and to support the base plate when suspended on a wall. The device is further provided with a hinge member pivotally mounted on top of the gripping member, so as to provide for pivotal movements of the base plate which is mounted by means of the slidable suspension device.

U.S. Pat. No. 4,253,268 teaches a toy building block set that has flat plate elements of semi-elastic plastic materials that interlock with pressure inserted ball socket joints. The flat plates may have various geometric shapes such as triangles, squares, etc., with each side the same length and having identical mating ball and joint locking elements. Along each block side mid-spaced between the center and two corners are respectively a ball and socket. Means are provided for mounting shafts through holes in the plates.

U.S. Pat. No. 4,403,733 shows a track for toy trains that is made by detachably connecting a plurality of rail elements having lengthwise extending rail-forming ribs with tie elements provided with connecting members which are adapted to be clamped into cavities in the bottom of the rails adjacent the end thereof, so as to provide a sort of snap-locking device, including: in the rails: a lengthwise extending cavity in the bottom of the rails defined by side walls and end walls. In the bottom of the cavity adjacent the end walls there is provided an aperture which communicates with another aperture extending transversely through the rib on the top face of the rail, and in ties; pairs of upwardly extending spring clips interspaced at a distance corresponding to the gauge of the track and having a socket fitting into the cavity of the rails, a pair of upwardly extending, resiliently deformable tongues provided with outwardly projecting flanges, the lower faces of which are adapted to engage the upper face of the rails, when sockets are plugged into the cavities of the rails.

U.S. Pat. No. 4,726,515 shows a track system for toy vehicles that contains straight and curved track pieces at the end of which are reference points of a track grid having a track module which is a multiple of the building module.

U.S. Pat. No. 5,049,104 shows a connecting system for a toy building set comprises a first coupling part and a second coupling part, which are provided on their respective ones of a pair of building elements, adapted to be interconnected, and are formed with respective complimentary coupling elements. The coupling parts in the connecting elements of the invention are adapted to interconnect the elements by elastic movement of at least one coupling part. The interconnection is flexible and may be fixed with a clamping device, which blocks the elastic movement.

U.S. Pat. No. 5,061,218 shows toy building blocks capable of assembly in any selected one of a variety of arrangements of contiguous blocks which include a plurality of projections on one face of each block and a plurality of longitudinal and lateral channels on an opposite face of the block, the relative dimensions of the projections and the channels being such that the projections of one block are received in the channels of contiguous block in the selected arrangement for sliding engagement in longitudinal and lateral directions while the projections are engaged with the channel for enabling alterations in the arrangement of contiguous blocks as the assembly is constructed.

U.S. Pat. No. 5,094,643 teaches a toy set connection device which consists of two bushing parts which are fixedly mountable on the shaft. By means of an axial or rotational displacement of the second bushing part relative to the first bushing part, the whole shaft bushing can be anchored in a desired transverse groove on shaft. The anchoring may be released by pulling the second bushing apart from the first part.

U.S. Pat. No. 5,209,693 teaches toy building blocks of the type having an array of sockets on one principal face and a matching array of projections on the opposite face that can be wedged into the sockets of another block are also joinable in an end to end relationship which enables lateral pivoting of one block in either direction relative to the block with which it is linked. In the preferred form, the opposite ends of the blocks are linkable to still other blocks in a manner which enables pivoting or flexing in an orthogonal direction. This enables assembly of interlocking blocks into a greater variety of different constructions and enables pivoting of linked portions of an assembled construction in a greater number of different directions.

U.S. Pat. No. 5,411,428 shows a block unit for a toy block that contains a block body having protrusions and recesses through which the block body is freely connectable to other block units. A rotary shaft is rotatably supported in the block body in such manner that the rotary shaft is extended in a block coupling direction in which the block unit is coupled to the other block units through the protrusions and recesses thereof. The block unit may include a drive source such as an electric motor mounted therein.

U.S. Pat. No. 5,427,558 teaches a toy building set element which is formed of a first part which is slidable and resiliently journaled with respect to the first part. Both of the parts have coupling elements thereon which permit coupling of the parts to the other elements of the toy building set. One of the parts may be adapted to receive a shaft through a cylindrical opening that runs perpendicular to the displacement direction of the parts with respect to each other.

U.S. Pat. No. 5,527,201 shows toy building pieces which may be advantageously used in conjunction with POPSICLE sticks,or their generic equivalents, or other framing pieces or connectors. One or more faces of many of the building pieces apertures are defined in the surface thereof to receive a framing piece such as a POPSICLE stick or connectors which are I-shaped in cross-section.

None of the prior art examples show or teach a plurality of toy block configurations that are slidably, pivotally and fixably coupled to one another and which are further capable of three dimensional slidable and pivotal maneuvering with respect to one another as taught by the present invention.

SUMMARY OF THE INVENTION

A toy block set includes a plurality of toy block configurations that are slidably, pivotally and fixably coupled to one another and which are further capable of three dimensional slidable and pivotal maneuvering with respect to one another by virtue of rail extension members, rail guide members and pivot members. A first group of the block configurations includes embodiments with a rail extension member which consists of a first thinner segment and a second wider segment. A second group of the block configurations includes embodiments with rail guide members which are configured to permit multi-directional movement of the rail extension members therethrough. A third group of the block configurations includes embodiments with pivot members which are configured to permit multi-directional pivotal and slidable movement of the rail extension members therethrough. In an alternative embodiment, the rail extension members may be independent pieces.

BRIEF DESCRIPTION OF THE DRAWINGS

The present invention should be more fully understood when the specification herein is taken in conjunction with the drawings appended thereto, wherein:

FIGS. 52 and 51 show a present invention toy block with a pair of rail guide members and having a pair of annular protrusions and a pair of annular impressions located opposite the protrusions;

DETAILED DESCRIPTION OF THE PRESENT INVENTION

The present invention is a toy block set which includes a plurality of toy block configurations that may be slidably, pivotally and fixably coupled to one another and which are further capable of three dimensional slidable and pivotal maneuvering with respect to one another by virtue of rail extension members, rail guide members and pivot members. A first group of the block configurations includes embodiments with at least one rail extension member which consists of a first thinner segment and a second wider segment. A second group of the block configurations includes embodiments with at least one pair of rail guide members which are configured to permit multi-directional movement of the rail extension members therethrough. A third group of the block configurations includes embodiments with pivot members which are configured to permit multi-directional pivotal and slidable movement of the rail extension members therethrough. In an alternative embodiment, the rail extension members may be independent pieces which are defined by I-rail members as described in more detail below.

The present invention toy blocks may be constructed out of any suitable material known to be used in the art and may likewise encompass any size, shape and dimension. It is one object of the present invention to provide a set of toy blocks which may be combined with conventional toy blocks, such as Legos blocks and other like blocks, so as to create a new interconnection profile. It is also an object of the present invention to create an independent set of toy blocks which may be combined in any variety of ways to establish a multitude of assembled formations which, when constructed, allow a user to move, slide and pivot individual toy blocks in such a manner so as to provoke three dimensional slidable and pivotal relative motion between toy blocks. A better understanding of the present invention will be achieved by reference to all of the Figures described herein below.

Figure 1:
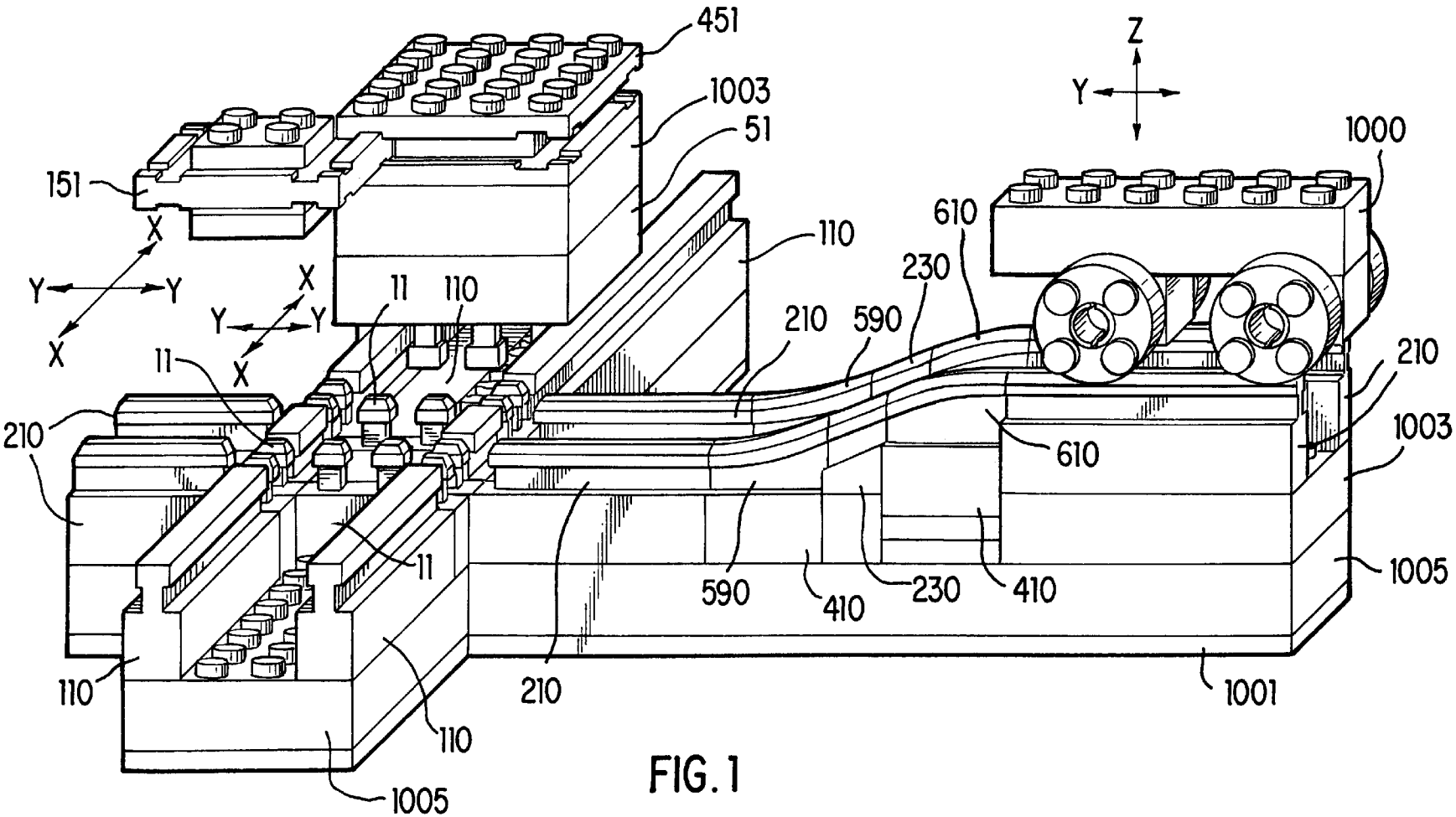
FIG. 1 shows a landscape view of an assembled arrangement of present invention toy blocks being interconnected with a plurality of conventional toy blocks and further showing details of the three dimensional movable and slidable capabilities thereof.
Figure 2:
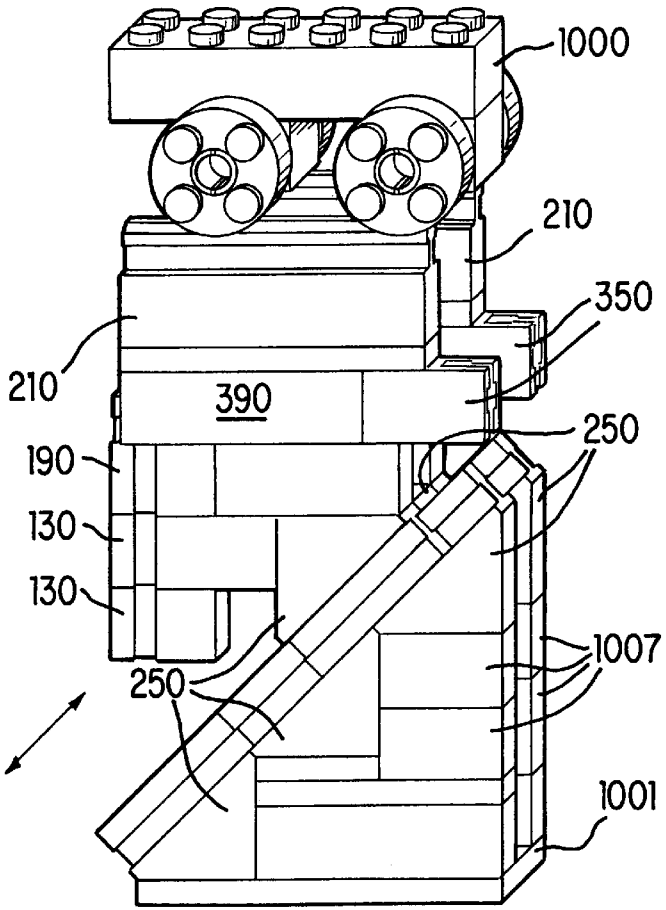
FIG. 2 shows a perspective view of another assembled arrangement of the present invention toy blocks being interconnected with a plurality of conventional toy blocks, also showing details of the three dimensional movable and slidable capabilities thereof.
Figure 107:
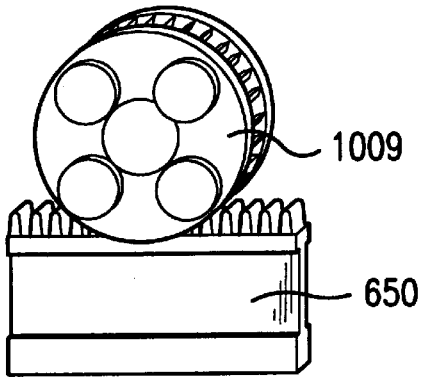

FIG. 1 shows a landscape view of an assembled arrangement of present invention toy blocks being interconnected with a plurality of conventional toy blocks and further showing details of the three dimensional movable and slidable capabilities thereof. FIG. 2 shows a perspective view of another assembled arrangement of present invention toy blocks being interconnected with a plurality of conventional toy blocks, also showing details of the three dimensional movable and slidable capabilities thereof. A more thorough conception of the present invention set of toy blocks, as demonstrated by FIGS. 1 and 2, will be achieved by viewing FIGS. 3 through 107 in conjunction therewith.

Figure 3:
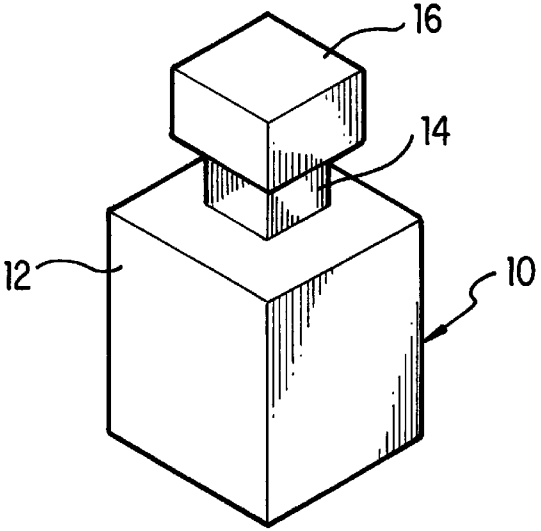
FIGS. 3 and 4 show a perspective view of a present invention toy block having an upper rail extension member and an annular impression located opposite the rail extension member.
Figure 4:
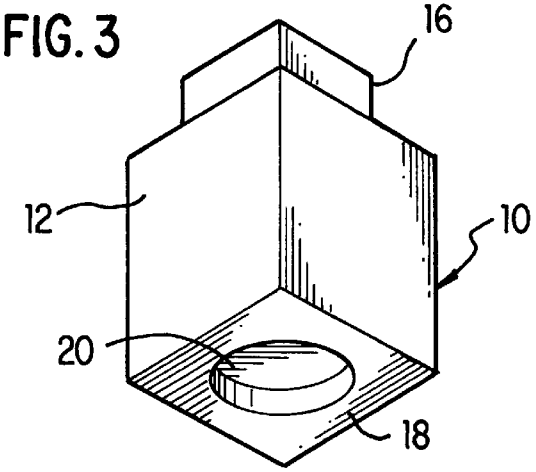

FIGS. 3 and 4 show a perspective view of a present invention toy block having an upper rail extension member and an annular impression located opposite the rail extension member. Referring to FIGS. 3 and 4, toy block 10 has rectangular box shaped main body 12 and has an upper rail extension member which is defined by first segment 14 and second segment 16 as shown. Annular impression 20 is defined in bottom 18 and is located opposite the upper rail extension member.

Figure 5:
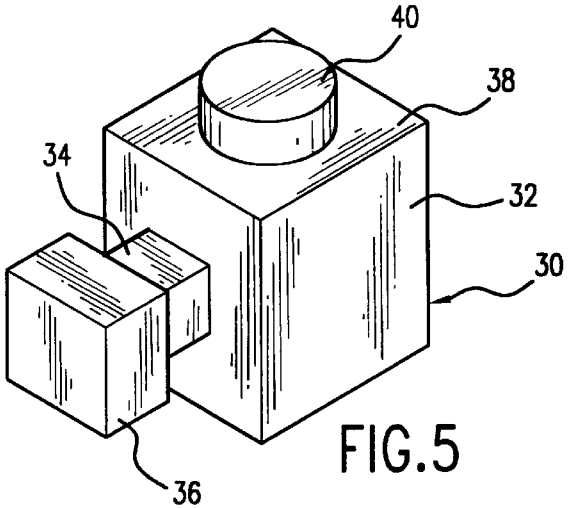
FIGS. 5 and 6 show perspective views of a present invention toy block having a side rail extension member and an annular protrusion and an annular impression located opposite the protrusion.
Figure 6:
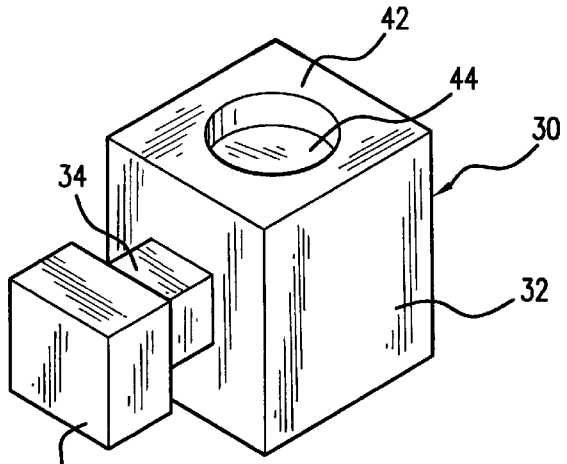

Referring to FIGS. 5 and 6, toy block 30 has rectangular box shaped main body 32 and has a side rail extension member which is defined by first segment 34 and second segment 36 as shown.

Annular impression 42 is defined in bottom 18 and is located opposite protrusion 40 which is located on top 38.

Figure 7:
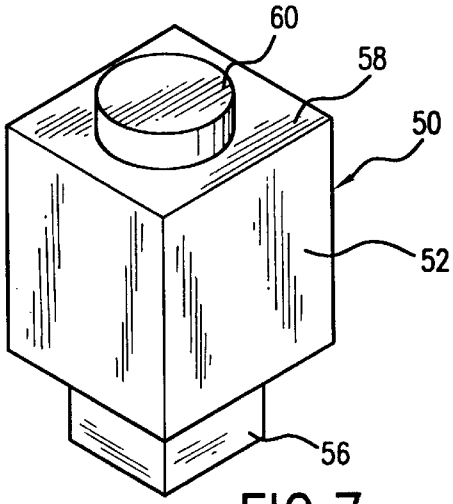
FIG. 7 shows a perspective view of a present invention toy block having a lower rail extension member and an annular protrusion located opposite the rail extension member.
Figure 8:
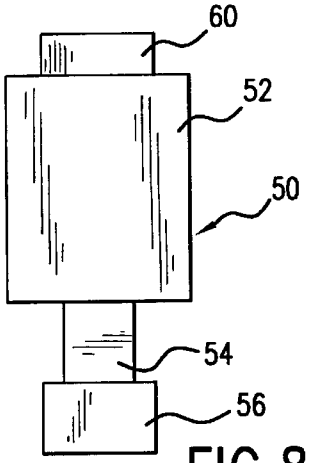
FIG. 8 shows a side view of the block shown in FIG. 7.

Referring to FIGS. 7 and 8, toy Block 50 has rectangular box shaped main body 52 and has a lower rail extension member which is defined by first segment 54 and second segment 56. Annular protrusion 60 is located on top 58 and is located opposite the lower rail extension member.

Figure 10:
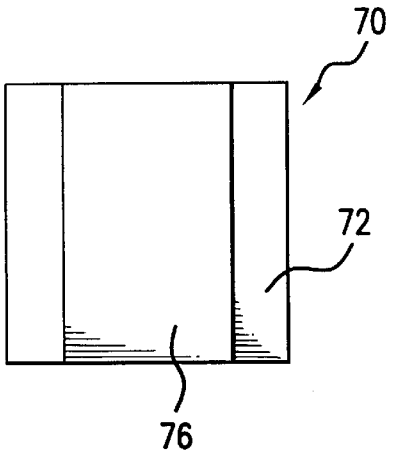
FIG. 10 shows a bottom view of the block shown in FIG. 9.
Figure 9:
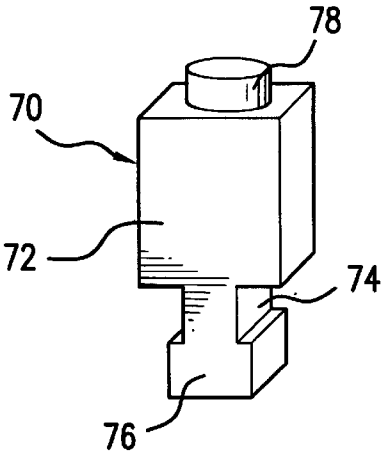
FIG. 9 shows a perspective view of a present invention toy block having a lower rail extension member, which, as shown here, extends across the entire width of the toy block, and shows an annular protrusion located opposite the rail extension member.

Referring to FIGS. 9 and 10, toy Block 70 has rectangular box shaped main body 72 and has a lower rail extension member which is defined by first segment 74 and second segment 76 as shown. Annular protrusion 78 is located on top of rectangular box shaped main body 72 and is located opposite the rail extension member.

Figure 12:
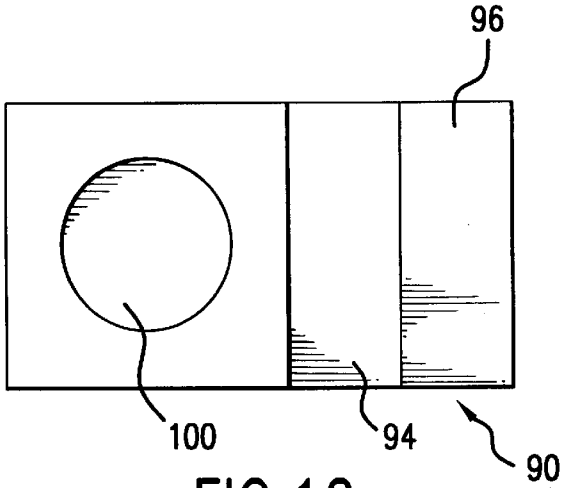
FIG. 12 shows a bottom view of the block shown in FIG. 11, illustrating the annular impression which is located opposite the annular protrusion.
Figure 11:
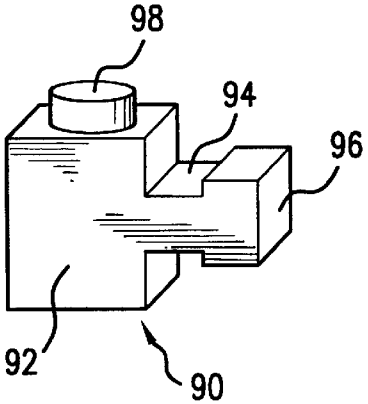
FIG. 11 shows a perspective view of a present invention toy block having a side rail extension member, which, as shown here, extends across the entire width of the toy block, and shows an annular protrusion located on top of the toy block.

Referring to FIGS. 11 and 12, toy block 9C has rectangular box shaped main body 92 and has 2 side rail extension member which is defined by first segment 94 and second segment 96. Annular protrusion 98 is located on top of rectangular box shaped main body 92 and annular impression 100 is located on the bottom of rectangular box shaped main body 92, opposite annular protrusion 98.

Figure 14:
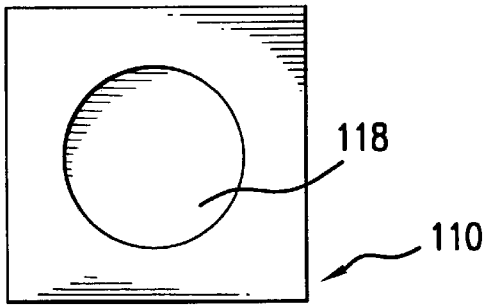
FIG. 14 shows a bottom view of the block shown in FIG. 13, illustrating the annular impression which is located opposite the rail extension member.
Figure 13:
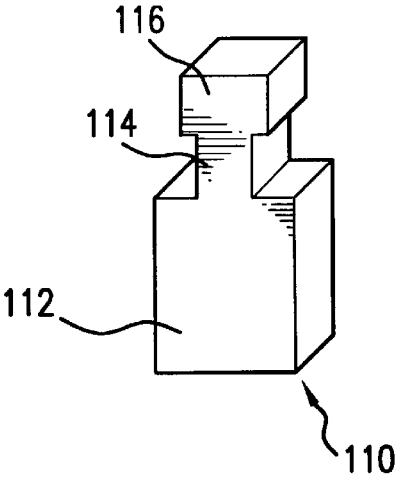
FIG. 13 shows a perspective view of a present invention toy block having a top rail extension member, which, as shown here, extends across the entire width of the toy block.

Referring to FIGS. 13 and 14, toy block 110 has rectangular box shaped main body 112 and has an upper rail extension member which is defined by first segment 114 and second segment 116. Annular impression 118 is located opposite the rail extension member as shown.

Figure 16:
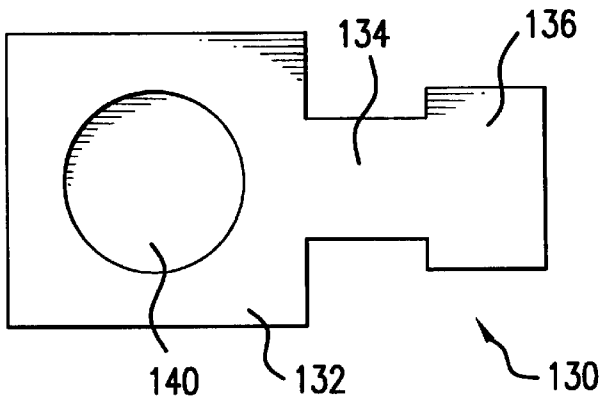
FIG. 16 shows a bottom view of the block shown in FIG. 15, illustrating the annular impression which is located opposite the annular protrusion.
Figure 15:
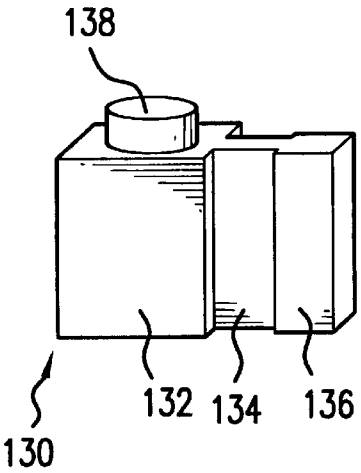
FIG. 15 shows a perspective view of a present invention toy block having a side rail extension member, which, as shown here, extends across the entire height of the toy block, and shows an annular protrusion located on top of the toy block.

Referring to FIGS. 15 and 16, toy block 130 includes rectangular box shaped main body 132 and has a side rail extension member which is defined by first segment 134 and second segment 136. Annular protrusion 138 is located on top of rectangular box shaped main body 132 and annular impression 140 is located on the bottom of rectangular box shaped main body 132 opposite protrusion 138.

Figure 18:
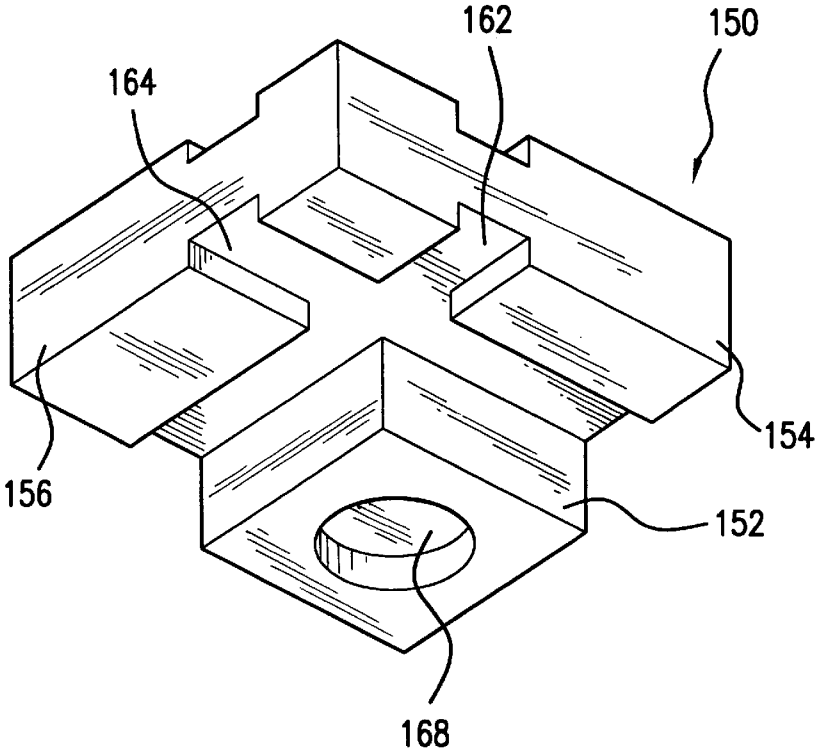
FIG. 18 shows a lower perspective view of the block shown in FIG. 17 illustrating the annular impression which is located opposite the annular protrusion.
Figure 17:
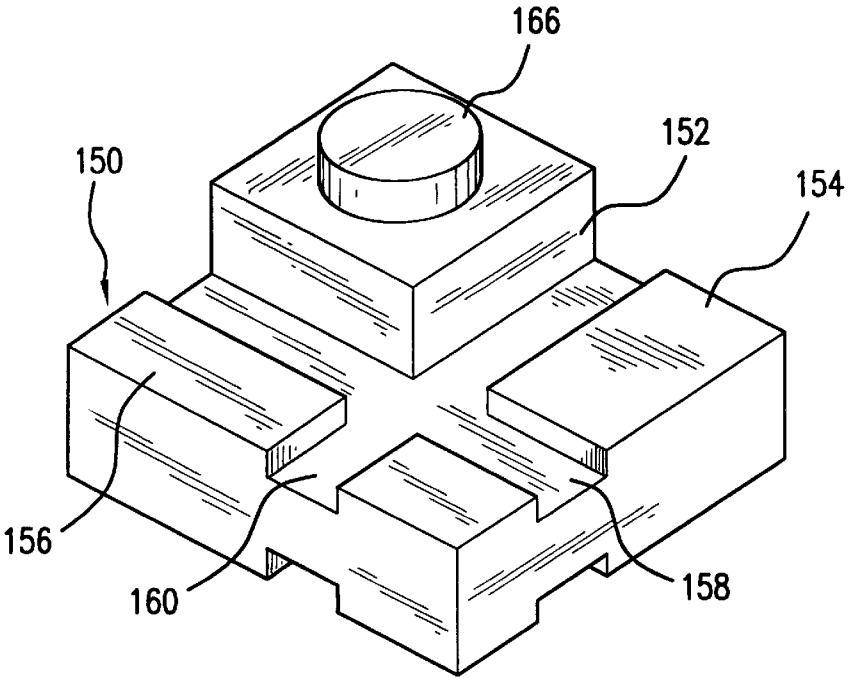
FIG. 17 shows an upper perspective view of a toy block having an annular protrusion located on top of the block and having two rail extension members which extend from adjacent sides and which merge into one another so as to establish a plurality of tracks which enable slidable axial movement of the block along two axes.

FIG. 17, shows an upper perspective view of a toy block having an annular protrusion located on top of the block and having two rail extension members which extend from adjacent sides and which merge into one another so as to establish a plurality of tracks which enable slidable axial movement of the block along two axes. FIG. 18 shows a lower perspective view of the block shown in FIG. 17, illustrating the annular impression which is located opposite the annular protrusion. Referring to FIGS. 17 and 18, toy block 150 has rectangular box shaped main body 152 and has a pair of side rail extension members 154 and 156 which extend along the sides of rectangular box shaped main body 152 and which merge into one another so as to establish tracks 158, 160, 162 and 164 which thereby enable slidable axial movement of toy block 150 along two axes. Annular protrusion 166 is located on top of rectangular box shaped main body 152 opposite annular impression 168.

Figure 19:
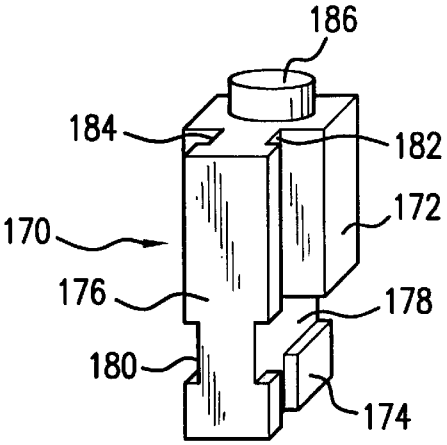
FIG. 19 shows a perspective view of a toy block having an annular protrusion located on top of the block and having two rail extension members which extend from adjacent sides and which merge into one another so as to establish a plurality of tracks which enable slidable axial movement of the block along two axes.
Figure 20:
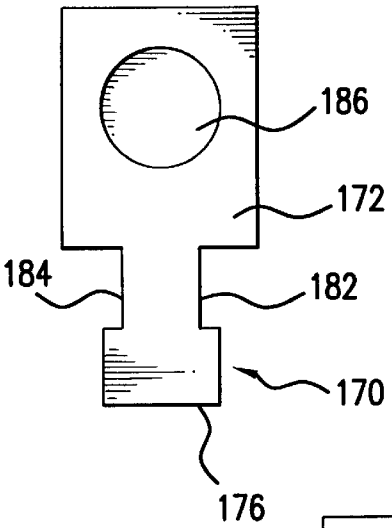
FIG. 20 shows a top view of the block shown in FIG. 19 illustrating the annular protrusion which is located opposite the lower rail extension member.

Referring to FIGS. 19 and 20, toy block 170 has rectangular box shaped main body 172 and has a pair of side rail extension members 174 and 176 which extend along the sides of rectangular box shaped main body 172 and which merge into one another so as to establish tracks 178, 180, 182, and 184 which thereby enable slidable axial movement of block 172 along two axes. Annular protrusion 186 is located on top of rectangular box shaped main body 172 opposite rail extension member 174.

Figure 21:
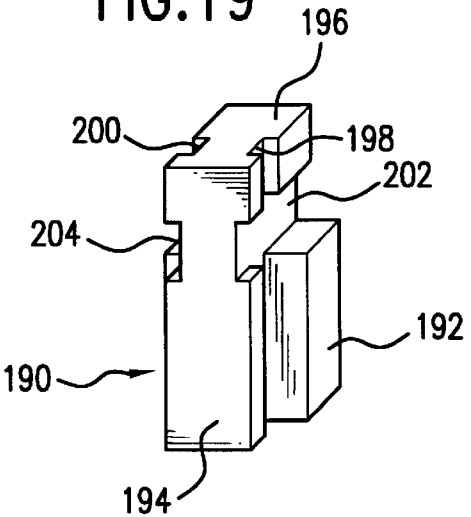
FIG. 21 shows a perspective view of a toy block having two rail extension members which extend from adjacent sides and which merge into one another so as to establish a plurality of tracks which enable slidable axial movement of the block along two axes.
Figure 22:
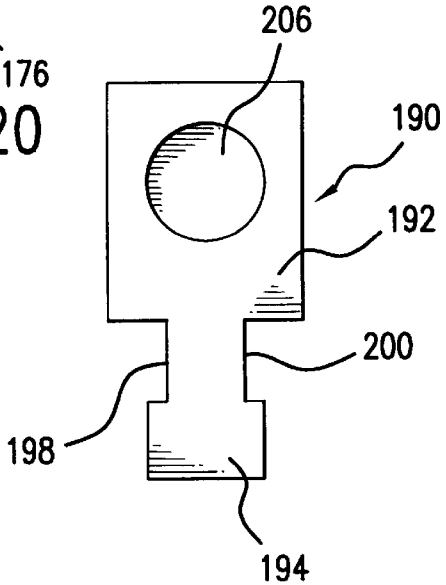
FIG. 22 shows a bottom view of the block shown in FIG. 19 illustrating the annular impression.

Referring to FIGS. 21 and 22, toy block 190 has rectangular box shaped main body 192 and has a pair of side rail extension members 194 and 196 which extend along the sides of rectangular box shaped main body 192 and which merge into one another so as to establish tracks 198, 200, 202, and 204 which thereby enable slidable axil movement of block 190 along two axes. Annular impression 206 is located on the bottom of rectangular box shaped main body 192 as shown.

Referring to FIGS. 23 through 26, toy Block 210 has rectangular box shaped main body 212 and has an upper rail extension member which is defined by first segment 214 and second segment 216. Second segment 216 has tapered sides 218 and 220 as shown. Tapered sides 218 and 220 are configured so as to permit an adequately sized and shaped wheel to roll thereacross as shown in FIG. 1. Annular impression 222 is located opposite the rail extension member.

Referring to FIGS. 27 through 30, toy block 230 has trapezoidally shaped main body 232 and has an upper rail extension member which is defined by first segment 236 and second segment 238. Second segment 238 includes tapered sides 240 and 242. Toy block 230 further includes inclined top 234. As shown here, the upper rail extension member extends along inclined top 234 so as to establish an inclined rail extension profile.

Figure 26:
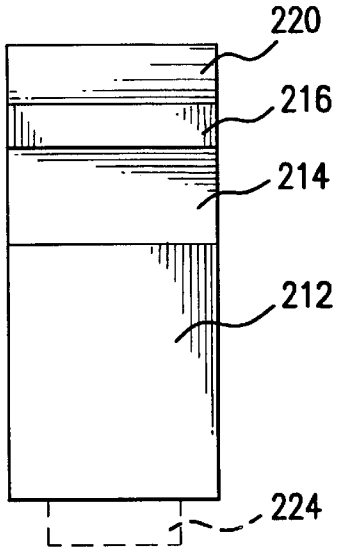
FIGS. 23, 24, 25 and 26 show different views of a present invention toy block having an upper rail extension member with tapered sides and an annular impression located opposite the rail extension member.
Figure 25:
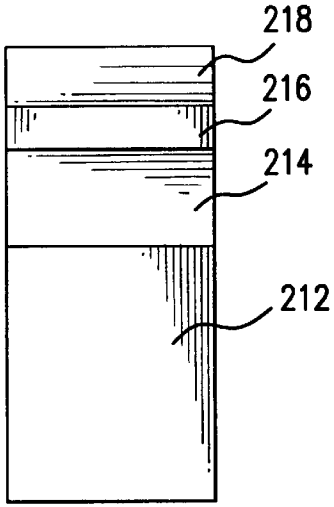
Figure 24:
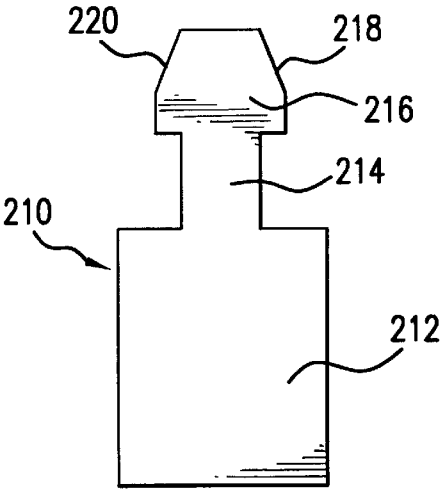
Figure 23:
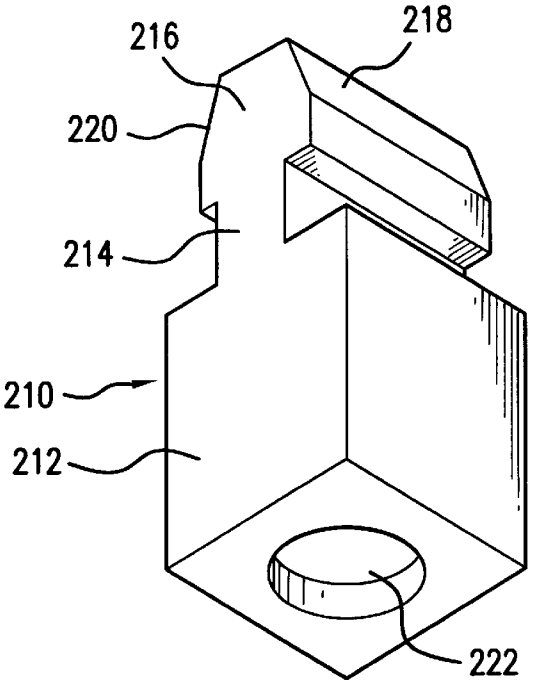
Figures 27, 28, 29, 30:
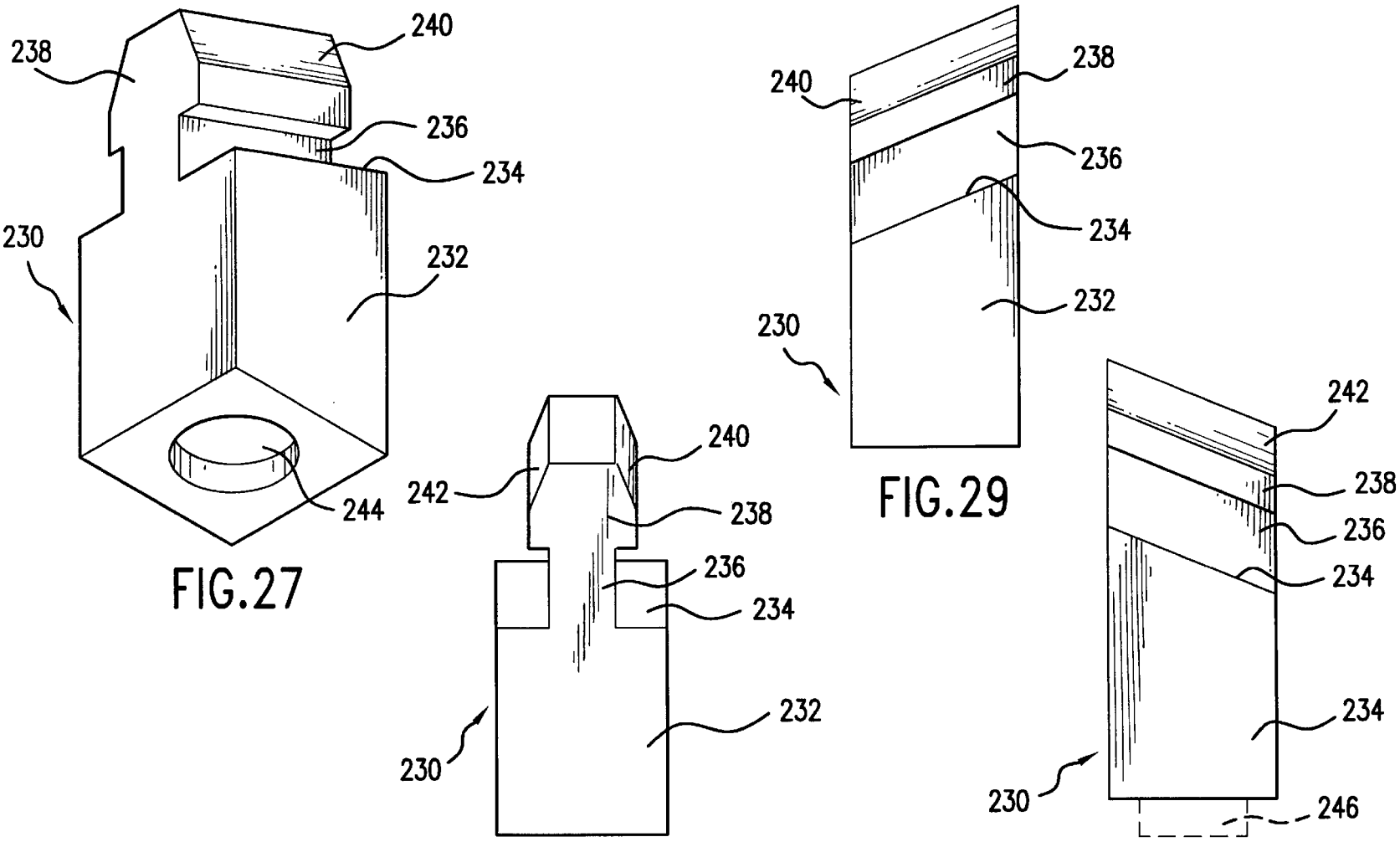
FIGS. 27, 28, 29 and 30 show different views of a present invention toy block having an upper rail extension member with tapered sides which extends along the inclined top of the block and further shows an annular impression located opposite the rail extension member.

Referring now to FIGS. 26 and 30, protrusions 224 and 246 are shown as alternative options which may be included on blocks 210 and 230 respectively.

Figure 33:
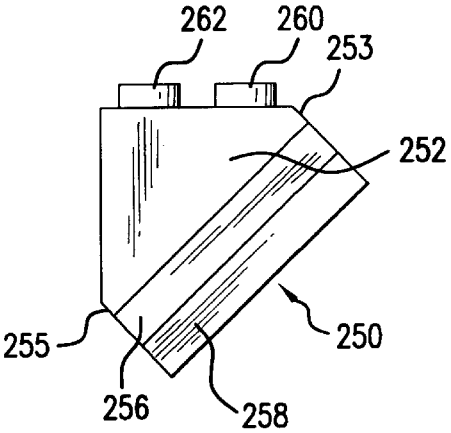
FIGS. 31, 32 and 33 show different views of a present invention triangularly shaped toy block which includes opposed angled sides and an inclined side which has a rail extension member extending therefrom and further includes a pair of annular protrusions and annular impressions.
Figure 32:
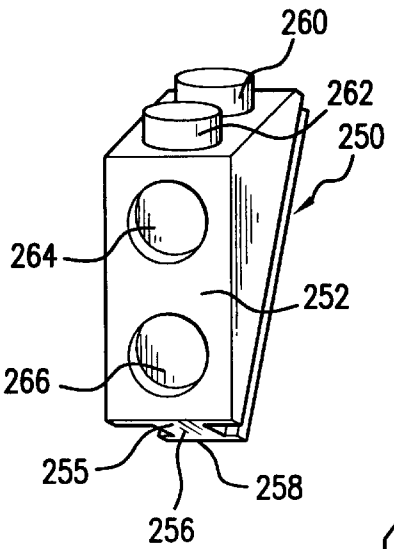
Figure 31:
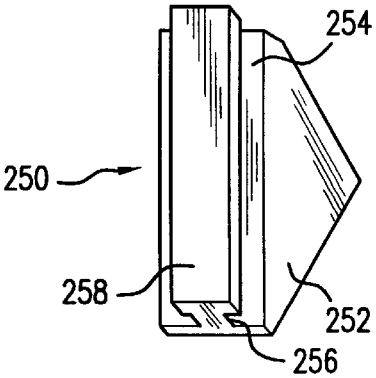

Referring to FIGS. 31 through 33, toy block 250 includes triangularly shaped main body 252 which has inclined side 254 and angled sides 253 and 255 as shown. The rail extension member defined by first segment 256 and second segment 258 extends along inclined side 254, thereby establishing an inclined rail extension profile.

As shown here, side 254 is provided with a 45° angle of inclination, but any other inclination may be employed without exceeding the scope of the present invention. Triangularly shaped main body 252 further includes a pair of annular protrusions 260 and 262 and also includes a pair of annular impressions 264 and 266. With reference to FIGS. 31 through 33, it should be noted that the number of protrusions and impressions may vary without exceeding the scope of the present invention. Accordingly, four impressions may be employed, in one instance, as well as three protrusions and a single impression in another instance or no impressions or protrusions at all and so on.

Figure 35:
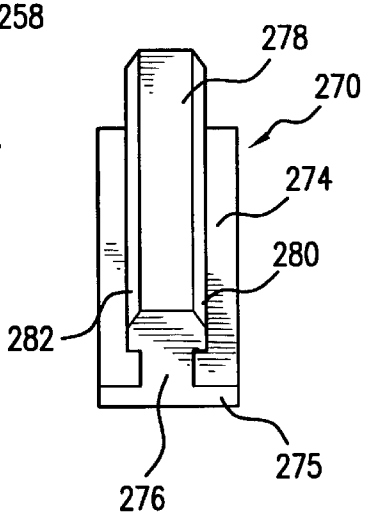
FIGS. 34 and 35 show different perspective views of a present invention triangularly shaped toy block which includes opposed angled sides and an inclined side which has a rail extension member with tapered sides extending therefrom.
Figure 34:
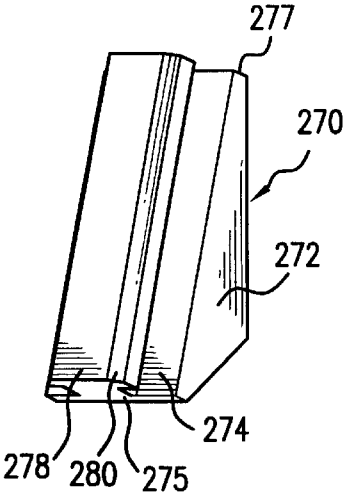
Figure 36:
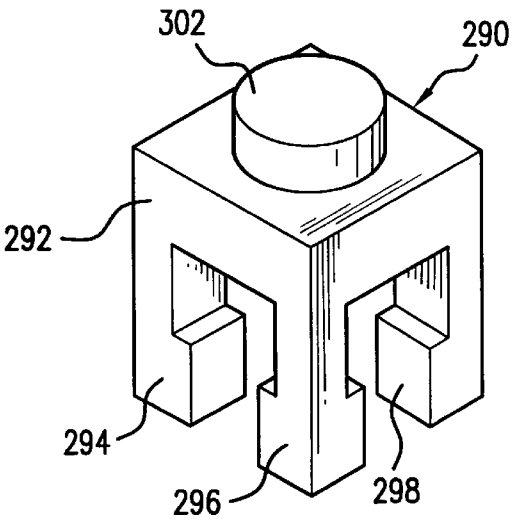
FIGS. 36, 37, 38 and 39 show different views of a present invention toy block with two pairs of rail guide members and an annular protrusion and, as an alternative, an annular impression.
Figure 38:
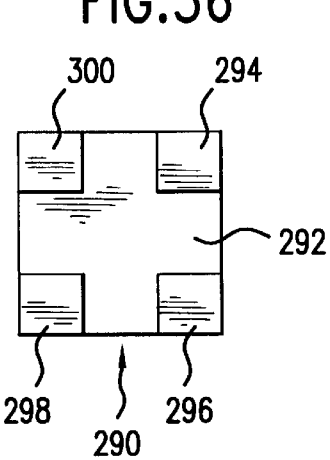
Figure 37:
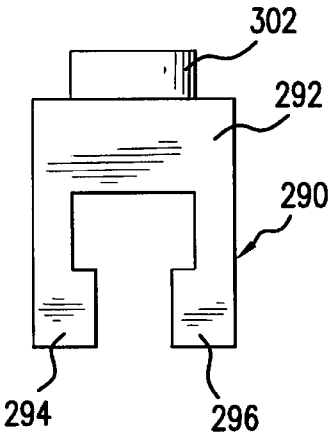

Referring to FIGS. 34 and 35, toy block 270 has triangularly shaped main body 272 and includes angled sides 275 and 277 and further includes inclined side 274. A rail extension member extends from inclined side 274 and is defined by first segment 276 and second segment 278. Second segment 278 includes tapered sides 280 and 282. With reference to FIGS. 34 and 35, it should be noted that protrusions and impressions (not shown here) may be included and may vary in number without exceeding the scope of the present invention.

Figure 39:
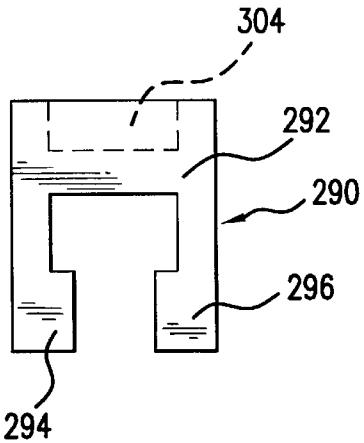

Referring to FIGS. 36 through 39, toy block 290 includes main body 292 which has four rail guide members 294, 296, 298, and 300 as shown. Annular protrusion 302 is located on top of main body 292. Referring now to FIG. 39, annular protrusion 302 may, in the alternative, be substituted by annular impression 304 as shown.

Figure 40:
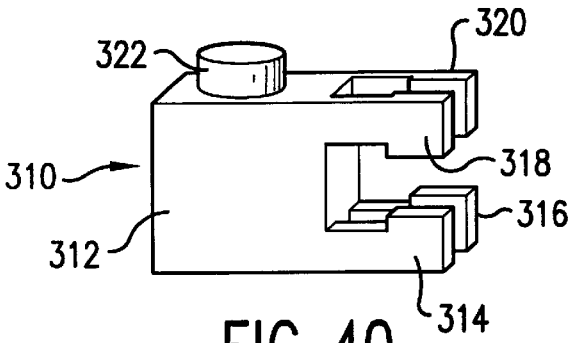
FIGS. 40, 41 and 42 show different views of a present invention toy block with two pairs of rail guide members and having an annular protrusion and an annular impression opposite the protrusion.
Figure 41:
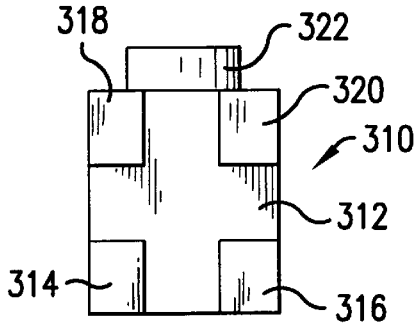
Figure 42:
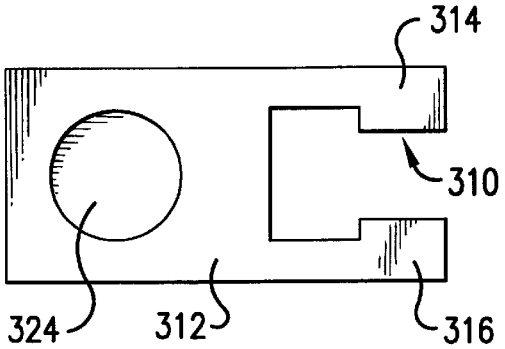

Referring to FIGS. 40 through 42, toy block 310 includes main body 312 which has annular protrusion 322 and annular impression 324 which is located opposite annular protrusion 322. Rail guide members 314, 316, 318 and 320 extend from the side of main body 312 as shown.

Figure 43:
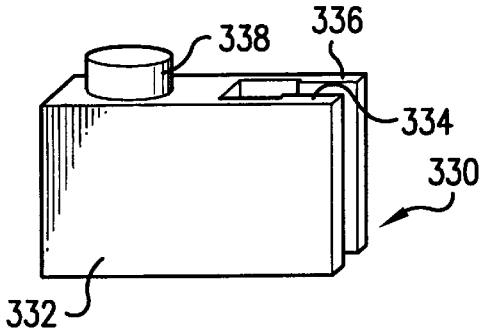
FIG. 43 shows a present invention toy block with a pair of rail guide members and having an annular protrusion.

Referring to FIG. 43, toy block 330 includes main body 332 and has annular protrusion 338 and includes a pair of rail guide members 334 and 336 as shown.

Figure 44:
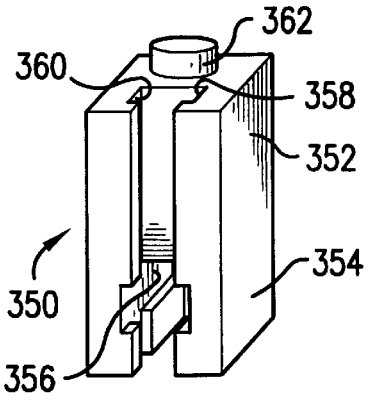
FIGS. 44 and 45 show different views of a present invention toy block with two pairs of rail guide members and an annular protrusion.
Figure 45:
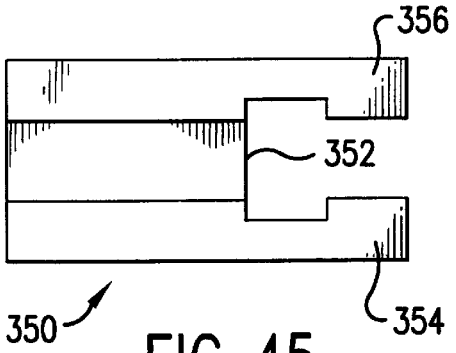

Referring to FIGS. 44 and 45, toy block 350 includes main body 352 and has annular protrusion 362. Rail guide members 354, 356, 358, and 360 extend along the sides of main body 352 and merge into one another so as to establish elongated rail guide walls.

Figure 46:
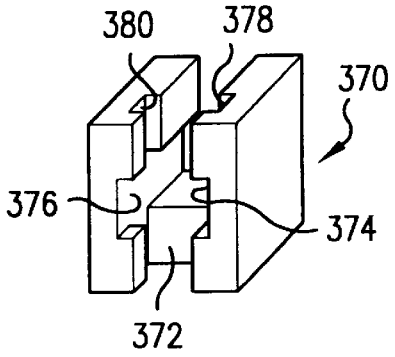
FIGS. 46 and 47 show different views of a present invention toy block with two pairs of rail guide members and an annular impression.
Figure 47:
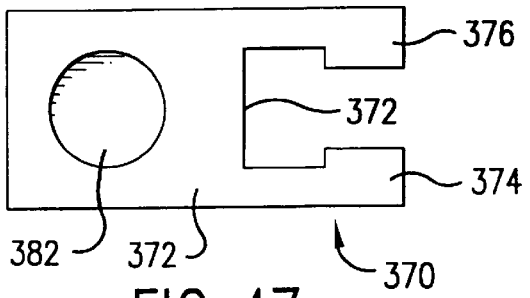

Referring to FIGS. 46 and 47, toy block 370 includes main body 372 which has annular impression 382 therein as shown. Rail guide members 374, 376, 378, and 380 extend from main body 372 as shown and merge into one another to establish elongated rail guide walls.

Figure 48:
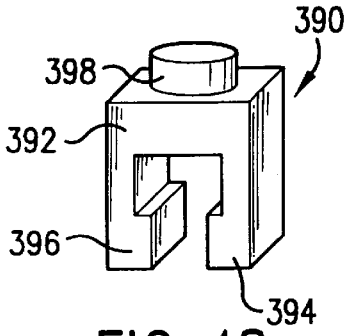
FIGS. 48 and 49 show a present invention toy block with a pair of rail guide members and having an annular protrusion.
Figure 49:
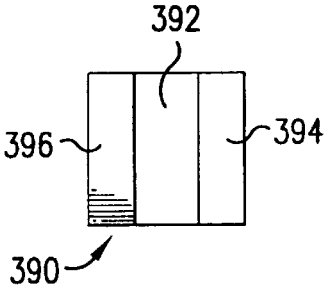

Referring to FIGS. 48 and 49, toy block 390 includes main body 392 and has annular protrusion 398 and further includes rail guide members 394 and 396.

Figure 50:
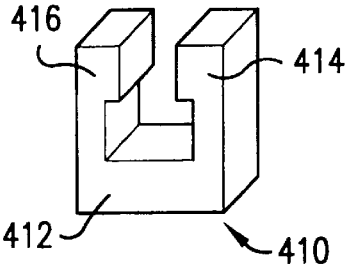
FIGS. 50 and 51 show a present invention toy block with a pair of rail guide members and having an annular impression.
Figure 51:
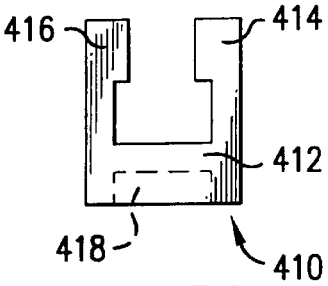

Referring to FIGS. 50 and 51, toy block 410 includes annular impression 418 and has rail guide members 414 and 416.

Figure 52:
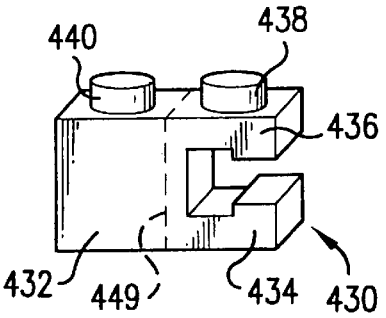
Figure 53:
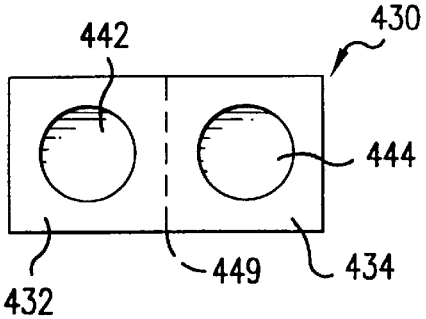
Figure 54:
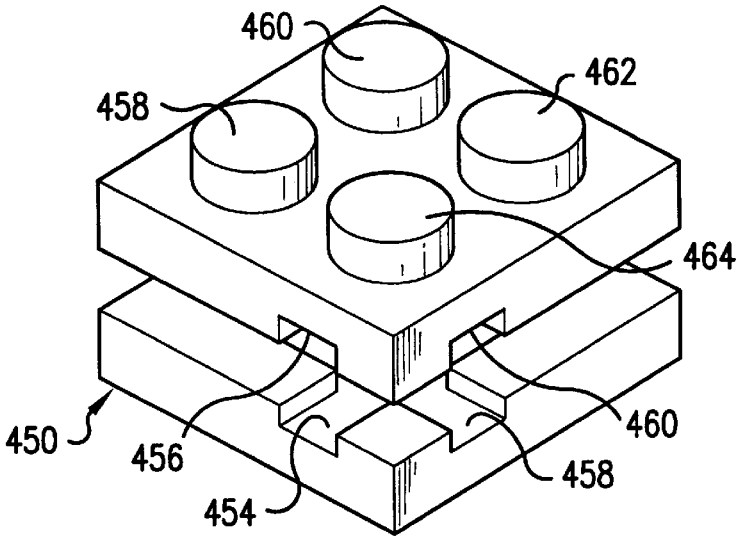
FIGS. 54, 55, 56 and 57 show different views of a present invention toy block with two pairs of rail guide members and having a plurality of annular protrusions and an open bottom which has a hollow friction post thereon.
Figure 55:
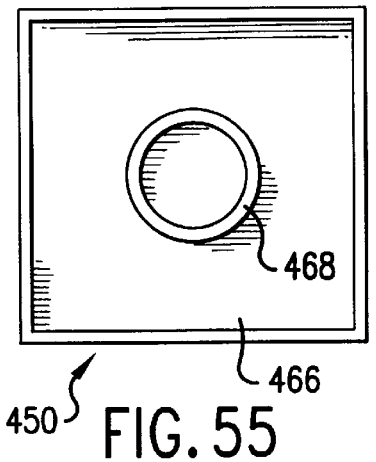
Figure 56:
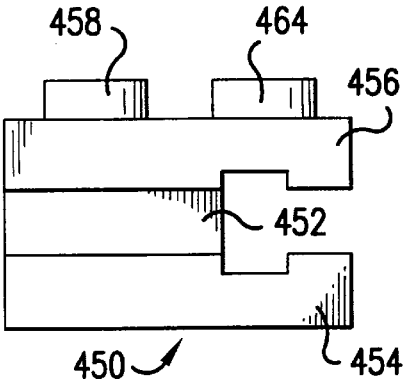
Figure 57:
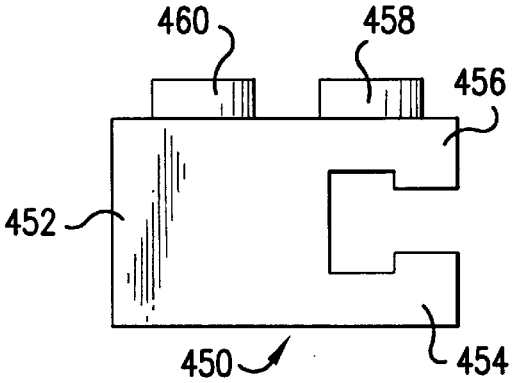

Referring to FIGS. 52 and 53, toy block 430 includes main body 432 and has annular protrusions 438 and 440. Annular impressions 442 and 444 are located opposite annular protrusions 438 and 440. Rail guide members 434 and 436 extend from main body 432. While toy block 430 is shown here as a single piece block, for illustrative purposes, dotted line 449 demonstrates a potential attachment point, in the event two blocks were used and coupled together to form a single block as shown by FIGS. 52 and 53.

Referring to FIGS. 54 through 57, toy block 450 includes main body 452 and has rail guide members 454, 456, 458, and 460 which extend along the sides of main body 452 as shown. Toy block 450 further includes annular protrusions 458, 460, 462, and 454. Toy block 450 also includes open-faced bottom 466 and hollow friction post member 468 which is adequately configured so as to allow block 450 to be interconnected with both present invention and conventional toy blocks having a plurality of annular protrusions thereon.

Figure 58:
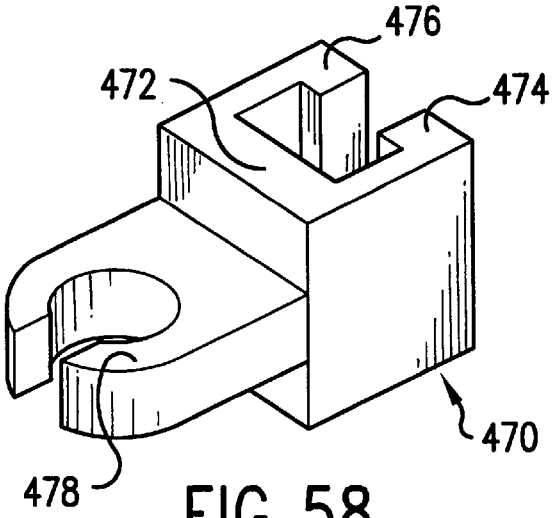
FIG. 58 shows a perspective view of a present invention toy block with a pair of rail guide members and a pivot extension member.
Figure 59:
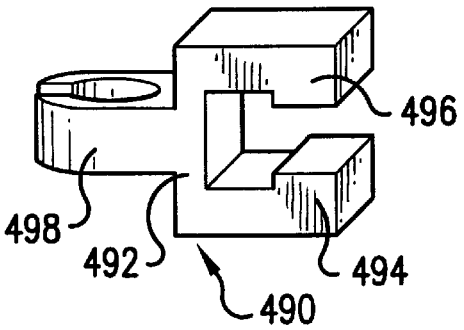
FIG. 59 shows a perspective view of a present invention toy block with a pair of rail guide members and a pivot extension member.
Figure 60:
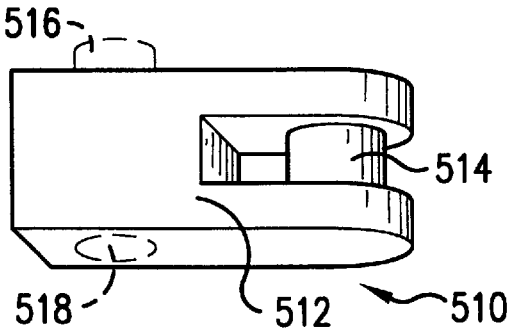
FIG. 60 shows a perspective view of a sample pivot post member for interconnection with the toy blocks shown in FIGS. 58 and 59.
Figure 61:
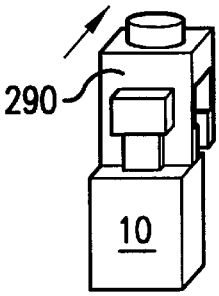
FIGS. 61 through 89 portray relative motion between the present invention toy blocks which are shown in FIGS. 3 through 60.
Figure 62:
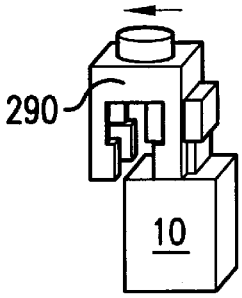
Figure 63:
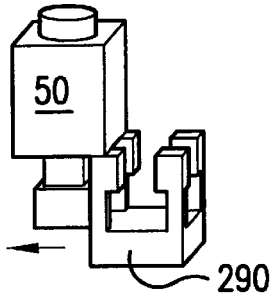
Figure 64:
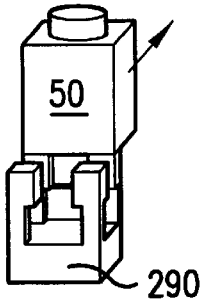
Figure 65:
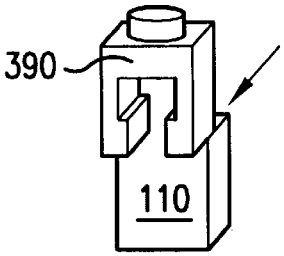
Figure 66:
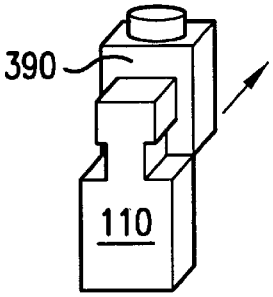
Figure 67:
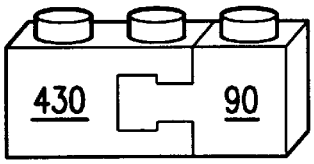
Figure 68:
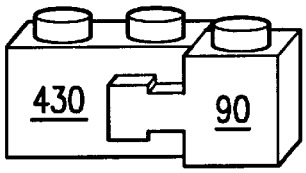
Figure 69:
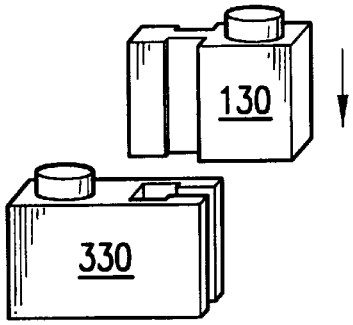
Figure 70:
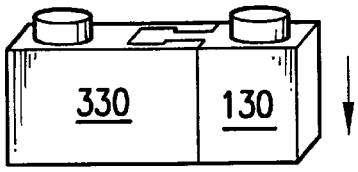
Figure 71:
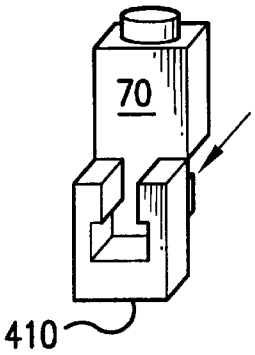
Figure 72:
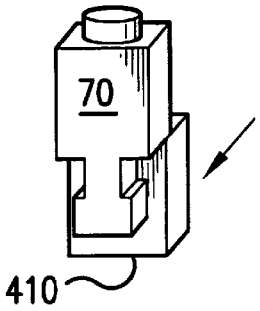
Figure 73:
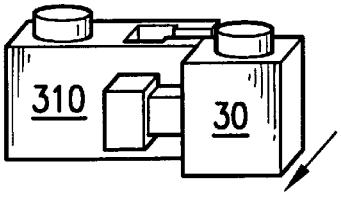
Figure 74:
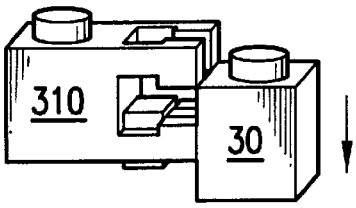
Figure 75:
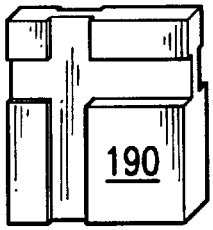
Figure 76:
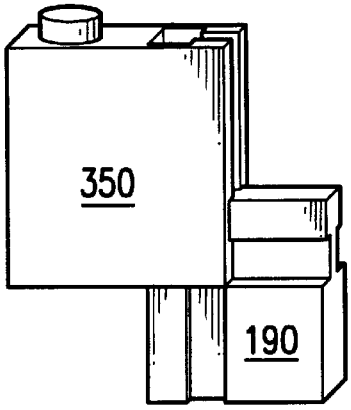
Figure 77:
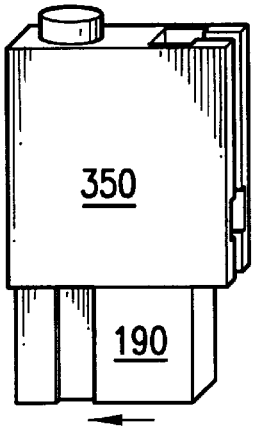
Figure 78:
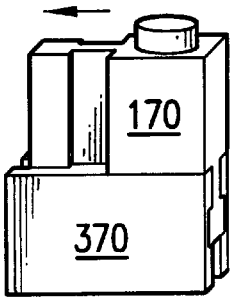
Figure 79:
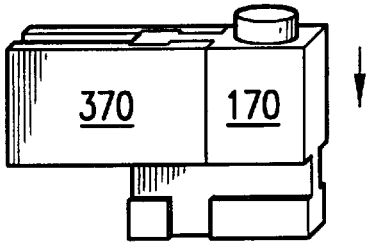
Figure 80:
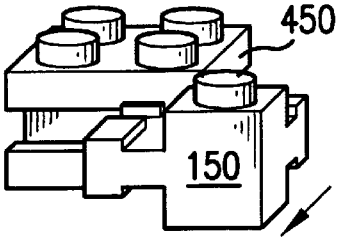
Figure 81:
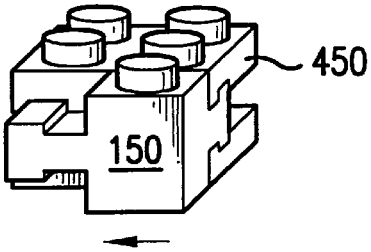
Figure 82:
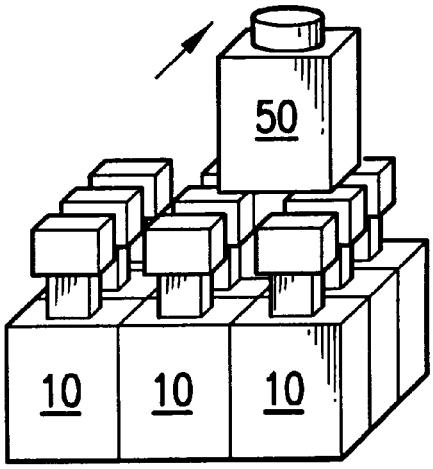
Figure 83:
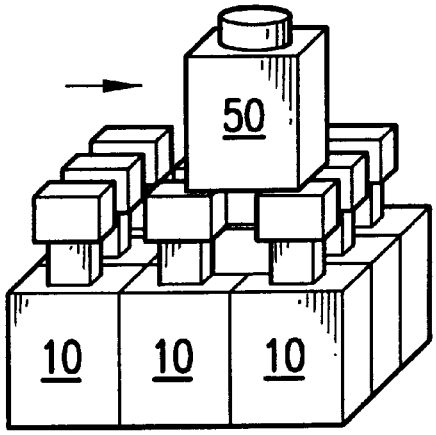
Figure 84:
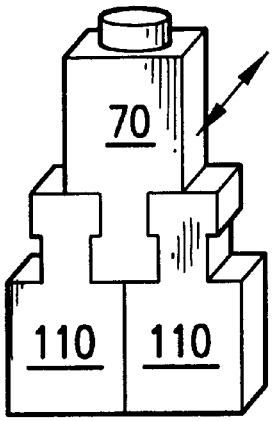
Figure 85:
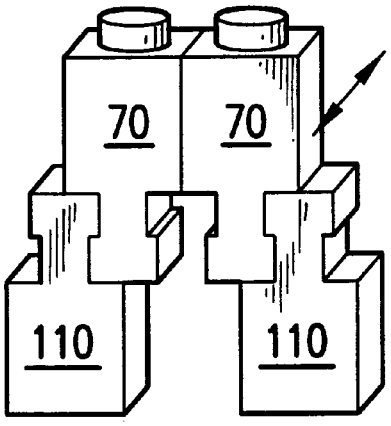
Figure 86:
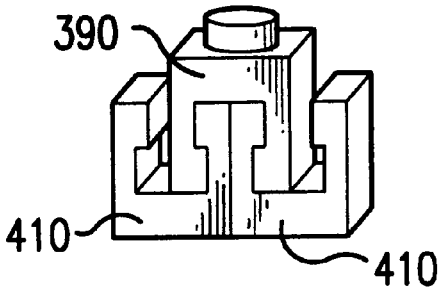
Figure 87:
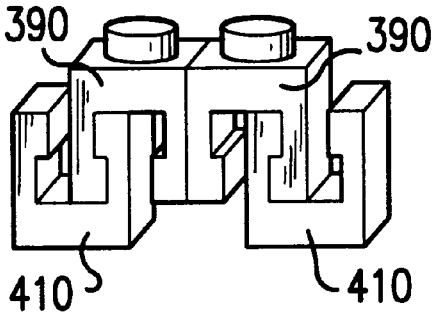
Figure 88:
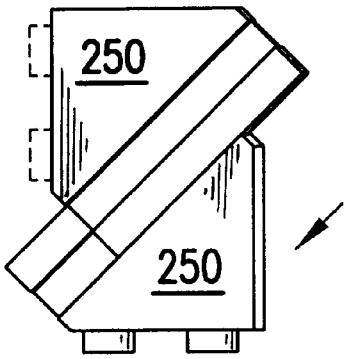
Figure 89:
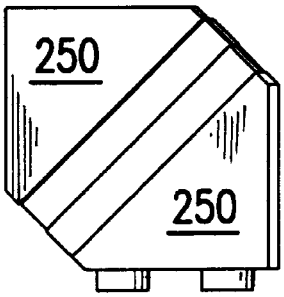
Figure 90:
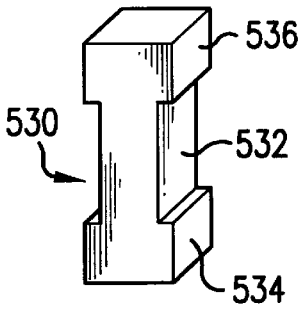
FIGS. 90, 91, 92, 93, 98 and 99 show a present invention I-rail member for use with other present invention toy blocks, and further portray relative motion between the present invention I-rail member and other present invention toy blocks.

Referring to FIG. 58, toy block 470 includes main body 472 and has rail guide members 474 and 476. Pivot member 478 extends outwardly opposite rail guide members 474 and 476. Referring now to FIG. 59, toy block 490 includes main body 492 and has rail guide members 494 and 496 and pivot member 498. Referring to FIG. 60, pivot post member 510 includes main body 512 and pivot post 514. Main body 512 may include annular protrusion 516 and annular impression 518 as disclosed. It should be understood that pivot post member 510 may comprise any number of shapes and sizes and that the configuration disclosed herein is merely employed for illustrative purposes only. What is meant to be conferred by FIGS. 58 through 60 is the present invention's facilitation of three dimensional axial rotation and simultaneous axial slidable motion of toy blocks through rail guide members 474, 476, 494 and 496.

FIGS. 61 through 89 demonstrate various relative motion profiles between present invention toy blocks. The arrows are provided for illustrative purposes only and are provided to further enhance the portrayal of relative motion and should not be construed to be either a limiting factor or as an enhancing factor in terms of the scope of the present invention. Particular note should be made of FIGS. 82 through 89 wherein each of those Figures demonstrate slidable multi-dimensional interconnection and relative motion between like toy blocks. Thus, it is to be understood that the present invention toy blocks are capable of not only interconnection with other dissimilar toy blocks but also with like present invention toy blocks.

Figure 91:
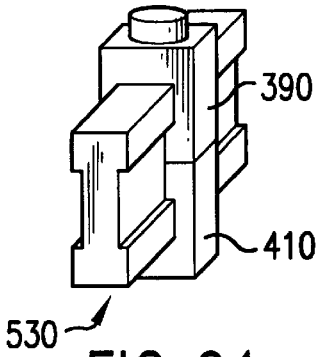
Figure 92:
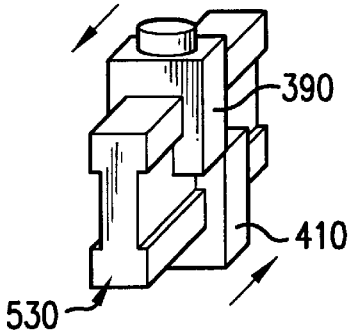
Figure 93:
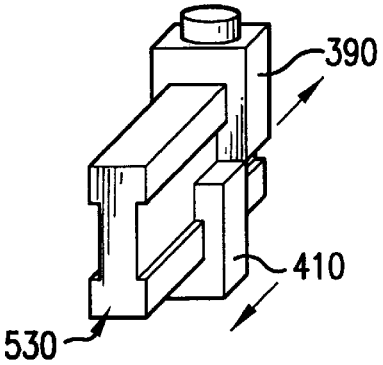

Referring to FIGS. 90 through 93, I-rail member 530 includes main body 532 and has segments 534 and 536 which are configured to engage rail guide members such as those shown by FIGS. 91 through 93.

Figure 94:
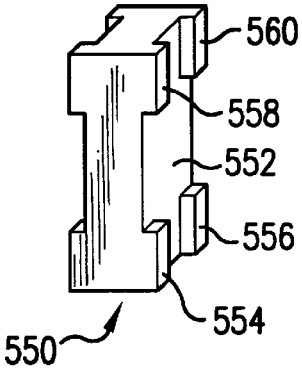
FIG. 94 shows an alternative embodiment of a present invention I-rail member.

Referring to FIG. 94, I-rail member 550 includes main body 552 and has segments 554, 556, 558, and 560 as shown. It is to be understood that I-rail member 550 is configured so as to permit multi-directional, axial, slidable motion thereabout.

Figure 95:
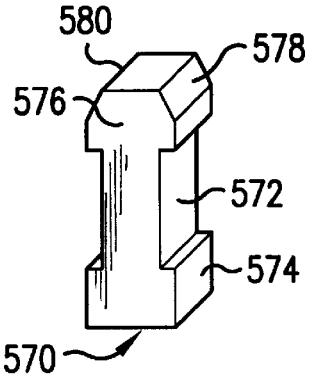
FIG. 95 shows another alternative embodiment of a present invention I-rail member.

Referring to FIG. 95, I-rail member 570 includes main body 572 and has segment 574 and segment 576 which includes tapered sides 578 and 580.

Figure 96:
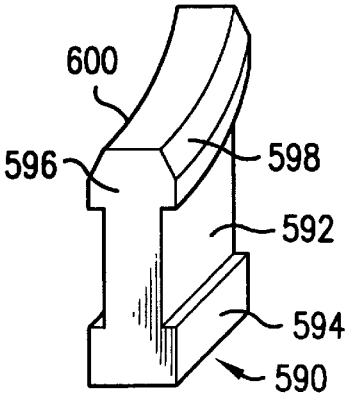
FIG. 96 shows another alternative embodiment of a present invention I-rail member.

Referring to FIG. 96, I-rail member 590 includes main body 592 and has segment 594 and segment 596 as shown. Extension 596 has a concavely curved configuration and includes tapered sides 598 and 600.

Figure 97:
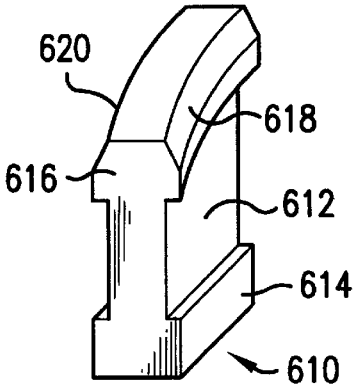
FIG. 97 shows another alternative embodiment of a present invention I-rail member.

Referring to FIG. 97, I-rail member 610 includes main body 612 and further includes segment 614 and segment 616 which has a convexly curved configuration and has tapered sides 618 and 620.

Figure 98:
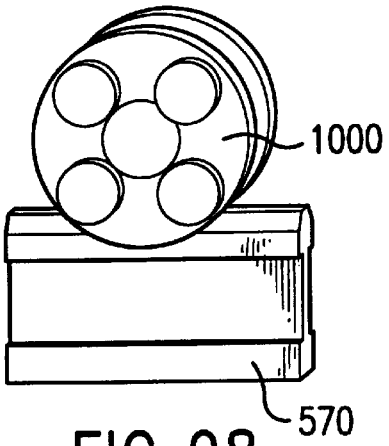
Figure 99:
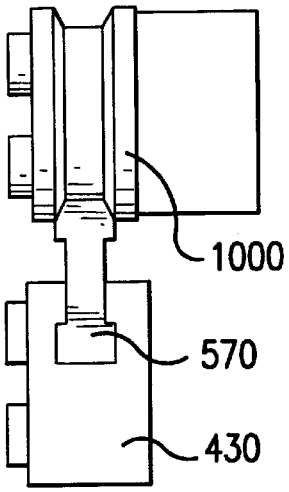

FIGS. 1, 98 and 99 show I-rail member 570 as disclosed in FIG. 95 demonstrating its capacity to permit a conventional adequately sized and shaped toy vehicle 1000 thereacross.

Figure 100:
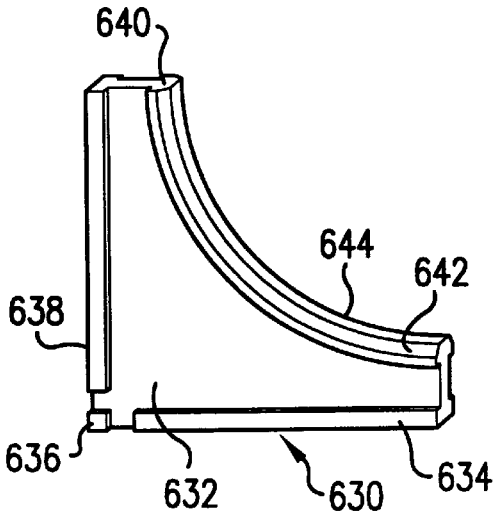
FIGS. 100 and 101 show a present invention I-ramp extension member for use with other present invention toy blocks as shown.
Figure 101:
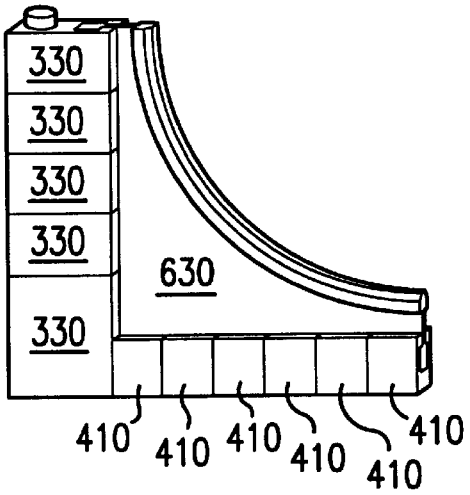
Figure 102:
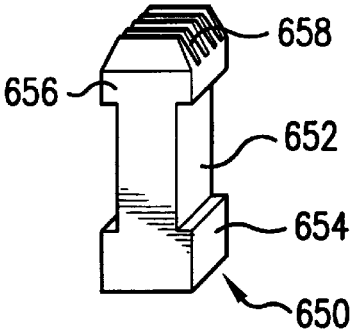
FIGS. 102, 103, 104, 106 and 107 show another alternative embodiment of a present invention I-rail member having a plurality of rack-like teeth thereon.
Figure 103:
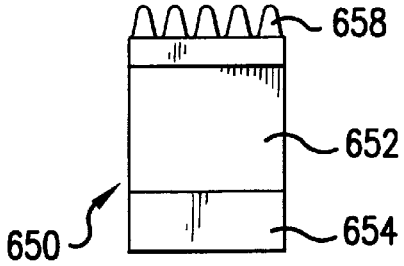
Figure 104:
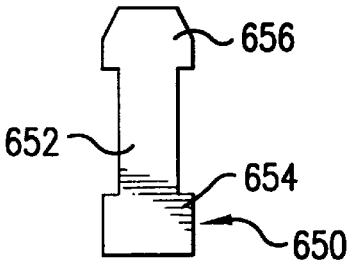

Referring to FIGS. 100 and 101, I-ramp extension member 630 includes main body 632 and has segments 634, 636, and 638 and further includes ramp-shaped extension 640 which includes tapers 642 and 644 as shown. As shown in FIG. 101, I-ramp extension member 630 may, for example, be combined with a plurality of toy blocks 330 and 410 as shown to permit its use and interconnection with other present invention and conventional toy blocks so as to establish a multi-dimensional, axial ramp-like motion profile. It should be understood, in view of elongated toy block 330 located at the bottom corner in FIG. 101, that the exact dimensions of like blocks may vary infinitely without exceeding the scope of the present invention.

Referring to FIGS. 102, 103, 104, 106 and 107, I-rail member 650 includes main body 652 and has segments 654 and 656. Segment 656 includes a plurality of rack-like teeth 658 for use with adequately sized and shaped wheels 1009 which have pinion-like teeth thereon.

Figure 105:
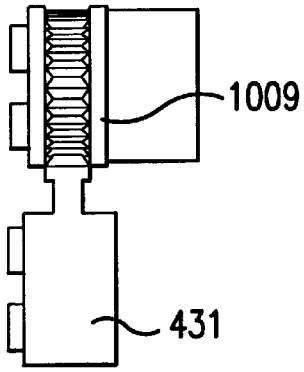
FIG. 105 shows a present invention toy block having a rail extension member and a plurality of pinion-like teeth.
Figure 106:
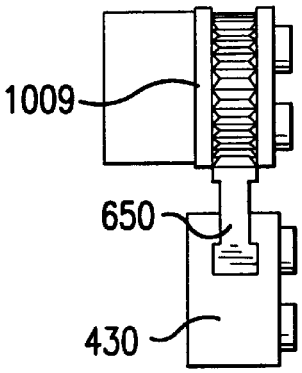

Referring now to FIG. 105, any present invention toy block, such as toy block 431, may include rail extension members with rack-like teeth 433 so as to function similarly to I-rail member 650 as shown.

Referring back to FIGS. 1 and 2 generally, all of the present invention toy blocks may be assembled as shown to permit three dimensional pivotal and slidable interconnection with conventional toy blocks such as blocks 1001, 1003, 1005 and 1007. Conventional toy block vehicle 1000, for instance, is shown as being capable of motion along the elongated rails established by present invention toy blocks 11, 210, 230, 410, and I-rail members 590 and 610. Wherefore, as toy vehicle 1000 moves in direction Y it will simultaneously drop along direction Z, thus affording a multi-dimensional course of motion. Present invention toy block 451 is indicative of present invention toy block 450 except that toy block 451 includes rail guide members which completely envelop the outer perimeter of toy block 451 so as to enable toy block 151 to traverse completely around toy block 451. Consequently, toy block 151 is indicative of toy block 150 except that toy block 151 includes rail extension members which completely envelop the outer perimeter of toy block 151 so as to enable toy block 151 to traverse completely around toy block 451. Similarly, present invention toy block 11 is indicative of toy block 10 except that toy block 11 is defined by a unistructurally molded unit composed of a plurality of toy blocks 10. It should be noted that toy block 11 further includes beveled rail extension members which permit axial motion in both direction X and direction Y. Present invention toy block 51 is shown as a unistructurally formed multi-block unit which is indicative of a plurality of present invention toy blocks 50. It should be obvious that toy block 51 is capable of motion along direction X and also direction Y while block 151 is simultaneously capable of motion along directions X and Y, thereby generating a unique multi-directional motility profile. Furthermore, present invention toy blocks 470 and 490 when combined with other present invention toy blocks, such as toy block 110 for example, enable pivotal rotation about one axis while simultaneously facilitating slidable axial motion of toy block 110 along either parallel or perpendicular axes. Thus, all of the toy block configurations shown herein are portrayed in their present form for illustrative purposes only and may therefore encompass an infinite number of comparable shapes, dimensions and sizes and may therefore generate an infinite number of three dimensional motility profiles without exceeding the scope of the present invention. With reference to FIG. 2, the double sided arrow indicates the relative motion of the upper and lower half of the assembly, wherein blocks 250 engage one another so as to permit upward and downward diagonal multi-dimensional motion as shown.

Referring generally to FIGS. 90 through 107, I-rail members may be used as surrogate connectors for toy blocks which include rail extension members thereby eliminating the need to employ, for instance, a toy block which includes a rail extension member. Thus, for example, the combination of I-rail member 570 with toy block 430 as shown in FIG. 99 may be supplanted by a single toy block such as block 431 as shown by FIG. 105.

Obviously, numerous modifications and variations of the present invention are possible in light of the above teachings. It is therefore understood that within the scope of the appended claims, the invention may be practiced otherwise than as specifically described herein.

What is claimed is:

1. A set of toy blocks capable of assembly in a plurality of arrangements and being capable of interconnection with conventional toy block sets and further enabling three dimensional slidable and pivotal attachment therewith, including:

(a) a first assortment of block configurations wherein each of said first block configurations includes a predetermined length, width and height and further includes a top, a bottom and at least four sides and includes at least one rail extension member which consists of a first thinner segment and a second wider segment adjacent to said first thinner segment, said first thinner segment having an outer dimension relative to an outer dimension of said wider segment, said thinner segment's dimension being less than said wider segment's dimension, each of said first thinner segment and said second wider segment having a length, a width and a height, each of said first thinner segment and said second wider segment having four sides wherein at least two of said thinner segment's sides are thinner relative to said wider segment's sides, each of said rail extension members extending from one of said top, bottom or sides of said first block configurations wherein at least two of each of said first thinner segment's and second wider segment's length, width and height are less than said first block configurations' length, width and height, said thinner segment being located adjacent to one of said top, bottom or sides of said first block configurations, said rail extension members having adequate size, shape and dimension so as to be capable of movable and slidable connection with a plurality of rail guide members;

(b) a second assortment of block configurations wherein each of said second block configurations includes a length, a width and a height and further includes a top, a bottom and four sides and includes at least one pair of rail guide members which consist of a first portion and a second portion, said first portion having adequate size, shape and dimension to skirt said first thinner segment and said second portion having adequate size, shape and dimension to skirt said second wider segment, each of said rail guide members extending from one of said top, bottom or sides of said second block configurations, said rail guide members having adequate size, shape and dimension so as to be capable of permitting slidable, multi-directional navigation of said rail extension members of said first block configurations therethrough; and (c) a third assortment of block configurations wherein each of said third block configurations includes a length, a width and a height and further includes a top, a bottom and four sides and includes at least one pair of rail guide members which consist of a first portion and a second portion, said first portion having adequate size, shape and dimension to skirt said first thinner segment and said second portion having adequate size, shape and dimension to skirt said second wider segment, each of said rail guide members extending from one of said top, bottom or sides of said third block configurations, said rail guide members having adequate size, shape and dimension so as to be capable of permitting slidable, multi-directional navigation of said rail extension members of said first block configurations therethrough, said third block configurations further including a pivot extension member wherein said pivot extension member extends from one of said top, bottom or sides of said third block configurations, said pivot member being capable of pivotal rotation about a pivot post.

2. The set of toy blocks according to claim 1 wherein each of said first thinner segment's and second wider segment's length, width and height are less than each of said first block configurations' length, width and height.

3. The set of toy blocks according to claim 1 wherein said second wider segment is tapered on opposite sides.

4. The set of toy blocks according to claim 1 wherein at least one of said first block configurations includes an inclined side having a predetermined angle of inclination, said extension member extending from said inclined side and comprising the same angle of inclination as said inclined side.

5. The set of toy blocks according to claim 4 wherein said second wider segment is tapered on opposite sides.

6. The set of toy blocks according to claim 1 wherein at least one of said first block configurations includes a curved side, said curved side having a predetermined contour, said extension member extending from said curved side and comprising the same contour as said curved side.

7. The set of toy blocks according to claim 6 wherein said second wider segment is tapered on opposite sides.

8. The set of toy blocks according to claim 1 wherein at least one of said first block configurations includes at least one annular protrusion.

9. The set of toy blocks according to claim 1 wherein at least one of said first block, configurations includes at least one annular impression.

10. The set of toy blocks according to claim 1 wherein at least one of said first block configurations includes at least one annular protrusion and at least one annular impression.

11. The set of toy blocks according to claim 1 wherein at least one of said second block configurations includes at least one annular protrusion.

12. The set of toy blocks according to claim 1 wherein at least one of said second block configurations includes at least one annular impression.

13. The set of toy blocks according to claim 1 wherein at least one of said second block configurations includes at least one annular protrusion and at least one annular impression.

14. The set of toy blocks according to claim 1 wherein at least one of said third block configurations includes at least one annular protrusion.

15. The set of toy blocks according to claim 1 wherein at least one of said third block configurations includes at least one annular impression.

16. The set of toy blocks according to claim 1 wherein at least one of said third block configurations includes at least one annular protrusion and at least one annular impression.

17. The set of toy blocks according to claim 1 including a pivot post member.

18. The set of toy blocks according to claim 17 wherein said pivot post member includes at least one of either an annular impression or an annular protrusion.

19. The set of toy blocks according to claim 3 wherein said wider segment is capable of conveying a conventional, adequately sized and shaped wheel thereacross.

20. The set of toy blocks according to claim 1 wherein each of said first block configurations' rail extension members is capable of slidable, multi-directional interconnection with other said rail extension members.

21. The set of toy blocks according to claim 1 wherein each of said second and third block configurations' rail guide members is capable of slidable, multi-directional interconnection with other said rail guide members.

22. The set of toy blocks according to claim 1 wherein at least one of said first, second and third block configurations includes an open bottom and a hollow friction post and further includes a plurality of annular protrusions.

23. The set of toy blocks according to claim 1 wherein at least one of said first, second and third block configurations includes an open bottom and a hollow friction post and further includes a plurality of annular impressions.

24. The set of toy blocks according to claim 1 wherein said first, second and third block configurations are adapted to be interconnected with conventional block units having a plurality of annular protrusions spaced at equal intervals, two end walls, two side walls and a top wall being opened in one direction and having a hollow friction post extending downwardly therefrom creating a recess therein.

25. The set of toy blocks according to claim 1 wherein at least one of said first, second and third block configurations are configured to permit frictional, slidable, multi-directional motion of said first, second and third block configurations relative to one another.

26. The set of toy blocks according to claim 1 wherein said first, second and third block configurations are capable of enabling three dimensional motion of said first, second and third block configurations relative to one another.

27. The set of toy blocks according to claim 1 wherein said first block configurations include a plurality of like blocks being unistructurally molded together to form a symmetrically segmented single block formation and wherein said second block configurations include a plurality of like blocks being unistructurally molded together to form a symmetrically segmented single block formation.

28. The set of toy blocks according to claim 1 wherein at least one of said first block configurations includes a plurality of rail extension members, said rail extension members establishing a set of elongated tracks which adjoin one another perpendicularly so as to permit continuous multi-directional motion.

29. The set of toy blocks according to claim 1 further including at least one rail member which is a separate elongated I-shaped rail member.

30. The set of toy blocks according to claim 29 wherein said I-shaped rail member includes a tapered portion.

31. The set of toy blocks according to claim 30 wherein said I-shaped rail member includes a curved side.

32. The set of toy blocks according to claim 31 wherein said I-shaped rail member is adequately configured so as to establish a triangularly shaped I-ramp member.

33. The set of toy blocks according to claim 30 wherein said I-shaped rail member includes a plurality of rack-like teeth so as to be capable of conveying a conventional, adequately sized and shaped wheel having a complimentary set of pinion-like teeth thereacross.

* * * * *